United States Patent [19]

Kato et al.

[11] Patent Number: 4,846,595

[45] Date of Patent: Jul. 11, 1989

[54] FRAME STRUCTURE OF A PRINTER WITH POSITIONING OPENINGS

[75] Inventors: Shingo Kato, Yokohama; Shunichi Ogawa, Hatano; Makoto Yumoto, Yokohama; Kazuhiro Suzuki, Sagamihara, all of Japan

[73] Assignee: Ricoh Co., Ltd., Tokyo, Japan

[21] Appl. No.: 54,416

[22] Filed: May 26, 1987

[30] Foreign Application Priority Data

| | | | |
|---|---|---|---|
| May 28, 1986 | [JP] | Japan | 61-124484 |
| May 28, 1986 | [JP] | Japan | 61-124485 |
| May 28, 1986 | [JP] | Japan | 61-124486 |
| May 28, 1986 | [JP] | Japan | 61-124487 |
| Jun. 19, 1986 | [JP] | Japan | 61-143695 |

[51] Int. Cl.[4] ..... B41J 25/28

[52] U.S. Cl. ..... 400/320; 29/281.1; 269/47; 269/309; 400/352; 400/691

[58] Field of Search ..... 400/691, 693, 352–356, 400/320; 29/281.1, 281.5; 269/47, 52, 309, 310, 903

[56] References Cited

U.S. PATENT DOCUMENTS

| | | | |
|---|---|---|---|
| 2,624,107 | 1/1953 | Carpenter | 269/309 X |
| 2,871,549 | 2/1959 | Arnold | 269/52 X |
| 3,057,449 | 10/1962 | Thomson | 400/691 X |
| 3,599,313 | 8/1971 | Litvin | 400/691 X |
| 4,049,109 | 9/1977 | Plaza | 400/175 X |
| 4,348,122 | 9/1982 | Balta | 400/477 X |
| 4,723,432 | 2/1988 | Whitley | 29/283.5 X |
| 4,729,551 | 3/1988 | Glessner | 269/47 |

*Primary Examiner*—Paul T. Sewell

*Attorney, Agent, or Firm*—Cooper & Dunham

[57] ABSTRACT

A printing apparatus such as a printer of the type using a type wheel includes two guide members which extend between a pair of side frames and each of which is fixed by riveting. A carrier is slidably mounted on the guide members. A carriage loaded with a type wheel and others is mounted on a carrier in such a manner as to be rotatable by 90 degrees between a predetermined print position and a wheel replace position behind the print position. A sensor for determining the presence/absence and the kind of a type wheel loaded in the carriage is provided.

7 Claims, 35 Drawing Sheets

Fig. 14
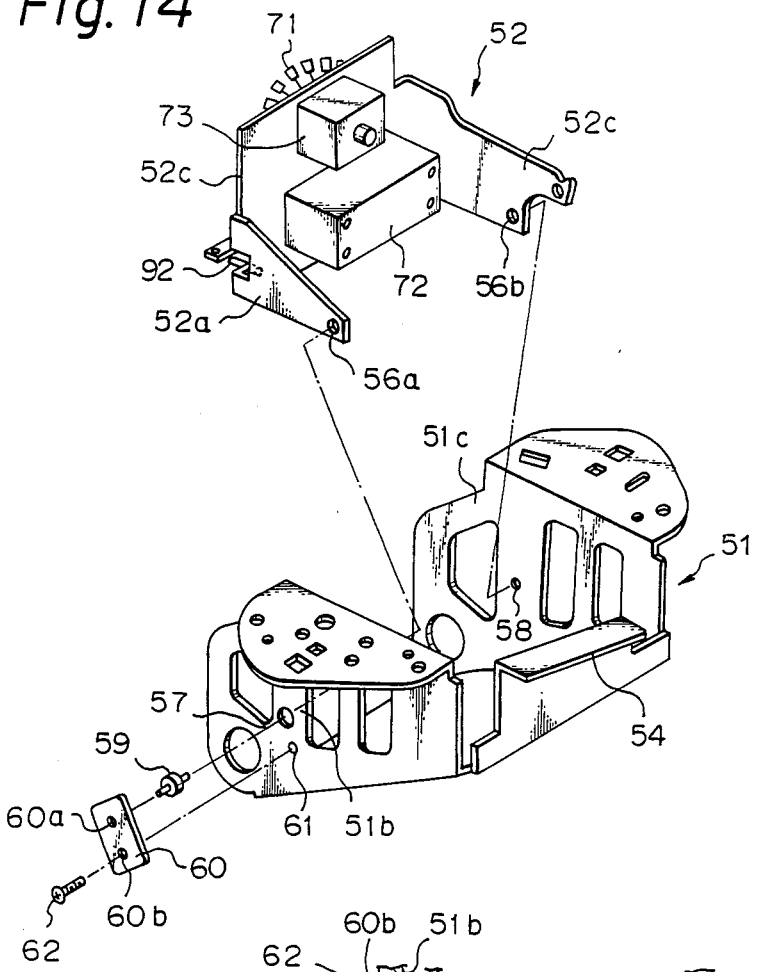
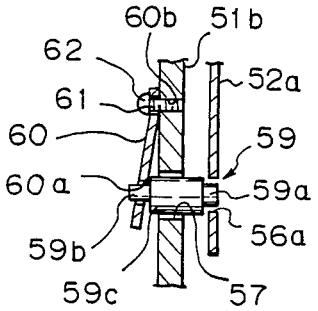
Fig. 15a
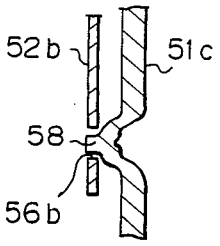
Fig. 15b

| Fig. 36A | Fig. 36B |
|---|---|

FRAME STRUCTURE OF A PRINTER WITH POSITIONING OPENINGS

BACKGROUND OF THE INVENTION

The present invention relates to an improvement in a printer, an electronic typewriter and other printing apparatus.

Generally, a printing apparatus includes two guide members which extend between a pair of side frames, and a carrier loaded with a printing mechanism and movable on and along the guide members. Specifically, while the guide members extend in parallel to a platen which is rotatably supported by the side frames, the carrier is driven by a space motor to slide on the guide members along the platen to thereby print out characters and others on a paper, which is wrapped around the platen. A prerequisite for accurate printing, therefore, is that the carrier be spaced by a constant amount from the platen and prevented from shaking up and down during its movement along the platen. To insure accurate relative position of the platen and guide members, it has been customary to fasten the guide members to the side frames by screws in parallel to the platen.

A problem with such a prior art printing apparatus is that since the fastening of the guide members to the side frame is performed during assembly of the apparatus, it has to be implemented with considerably accurate assembling work at the sacrifice of efficiency and cost.

A gear pulley which is rotated by the space motor adapted to move the carrier along the platen is rotatably supported by the output shaft of the motor through a bearing. In this kind of pulley support structure, to prevent the pulley from slipping off the motor output shaft, the bearing is press-fitted in a bore which is formed through the pulley and provided with a slightly smaller outside diameter than the bearing, whereby the pulley and the bearing are fixed to each other. Subsequently, the motor output shaft is inserted in a bore of the bearing and, then, E-rings or like stops are fitted on the shaft at opposite sides of the bearing. This allows the pulley to be rotatably supported on the motor output shaft while being prevented from slipping off the latter.

A disadvantage of the above support structure which relies on press-fitting is that the bearing which is press-fitted in the pulley increases the outside diameter and, therefore, the circumference of the pulley. The increment of the circumference of the pulley directly translates into that of the amount of drive of a member which is driven by the pulley in contact with the circumferential surface of the latter, resulting in inaccurate drive. Hence, in the case of such a gear pulley which is driven by a space motor adapted to drive a carrier along a platen, it is impossible to control the intercharacter spacing with accuracy. Specifically, a space wire is wrapped around the gear pulley and connected to the carrier, while the gear pulley is driven in a rotational motion by the space motor as stated. In this arrangement, even if the space motor is rotated stepwise to rotate the gear pulley, the amount of feed of the carrier becomes deviated from the one which was expected at the time of design of the gear pulley, due to the change in the circumference of the gear pulley.

Meanwhile, in a printer of the type using a type wheel, or daisy wheel as generally referred to, a carriage is rotatably supported by a carrier which is movable along a platen. Mounted on the carriage are a selection motor which carries a type wheel at the tip of its output shaft, a hammer solenoid for hammering the back of a type which is provided on the type wheel, etc. As the carrier is moved along the platen, the hammer solenoid hits against the back of a type on the type wheel to thereby print out information on a paper which is loaded on the platen. The carriage may be manually rotated rearward away from the platen to a predetermined position where the type wheel can be replaced with another.

In a prior art printer of the type described, however, the available range of rearward movement of the carriage is not more than about 60 degrees as measured from a predetermined print position. Hence, the space available between the type wheel in the rearward position and the platen, paper guide and others is too narrow to insert fingers for the replacement of the type wheel.

The printer using a type wheel is provided with an implementation for deciding whether a type wheel is loaded in the printer or not. This implementation consists of a reflecting or a transmitting portion provided in the type wheel itself, and a photosensor cooperative with the reflecting or transmitting portion. However, such an implementation is ineffective when it comes to type wheels which are not provided such a reflecting or a transmitting portion. Specifically, even if no type wheel is loaded in the printer, the photosensor would determine that a type wheel is present in the printer and allow the printer to operate, damaging the hammer, platen and others. For this reason, the kind of type wheels usuable with such a printer is limited to in turn limit the applicable range of a printer and other printing apparatus.

Further, the housing of a printer is usually made up of a top cover for covering a printing mechanism, a front cover for openably closing an opening which is formed through the top of the top cover, and a silencing cover attached to the front cover. The top cover is provided with various kinds of openings in addition to the top opening, e.g., an opening for mounting a platen knob, openings for receiving various kinds of operating knobs, and openings for accommodating various kinds of connectors. The top cover is customarily produced by molding resin, and a mold used is moved in the up-down direction with respect to the top cover. Hence, those openings provided in the direction of movement of the mold, i.e., provided on the top of the top cover can be formed with ease.

However, the top cover has to be provided with openings not only through its top but also through its both sides. Examples of such side openings are the opening for a platen knob and those for various connectors. Among such openings, those which open at the upper or lower end of the top cover as well may be formed as easily as those which are provided at the top, but those which are not open at the upper or lower end of the top cover have to be implemented with an extra mold, which is movable in a direction other than the up-down direction (a direction in which the openings are formed), or an extra machining step which follows a molding step. This increases the production cost of the top cover and, therefore, that of the entire printing apparatus.

SUMMARY OF THE INVENTION

It is therefore an object of the present invention to enhance accurate relative position of a platen and guide members and, therefore, accurate printout without resorting to precision assembly, and to cut down the cost of a printing apparatus.

It is another object of the present invention to reduce the cost of a printing apparatus by allowing openings to be formed through those walls of a top cover which extend in a different direction from the direction of movement of a mold, easily and economically without the need for an extra mold or postmachining.

It is another object of the present invention to facilitate replacement of a type wheel to thereby promote easy manipulation of a printer which uses the type wheel.

It is another object of the present invention to enhance easy detection of a type wheel, or driven member, by eliminating limitations otherwise imposed by a type wheel.

It is another object of the present invention to cause a member which is driven by a pulley in contact with the circumference of the latter to be driven accurately and adequately.

It is another object of the present invention to provide a generally improved printing apparatus.

A printing apparatus having a platen of the present invention comprises a pair of side frames, a guide member extending between the side frames, a carriage loaded with a printing mechanism, and a carrier rotatably supporting the carriage and slidably supported by the guide member to move along the platen, the guide member comprising a guide frame both ends of which are rigidly connected to the pair of the frames by caulking.

The above and other objects, features and advantages of the present invention will become apparent from the following detailed description taken with the accompanying drawings.

BRIEF DESCRIPTION OF THE DRAWINGS

FIG. 14 is an exploded perspective view of the carrier and a carriage;

FIGS. 15a and 15b comprise side elevations showing the carriage mounted on the carrier;

DESCRIPTION OF THE PREFERRED EMBODIMENTS

Figure 1:
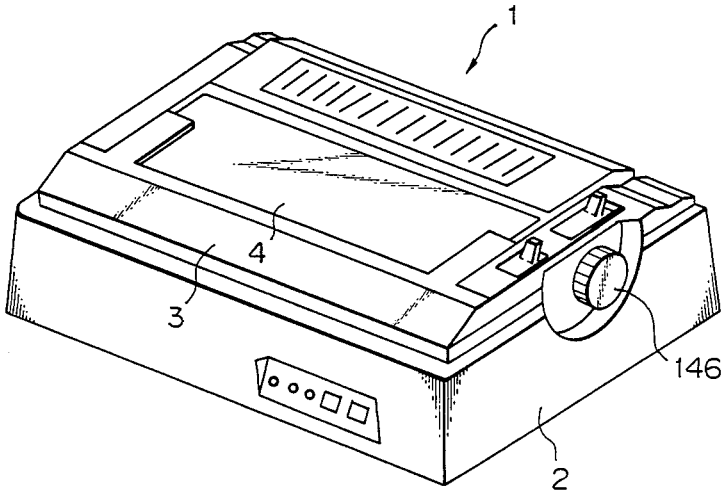
FIG. 1 is a perspective view showing a printing apparatus embodying the present invention.
Figure 2:
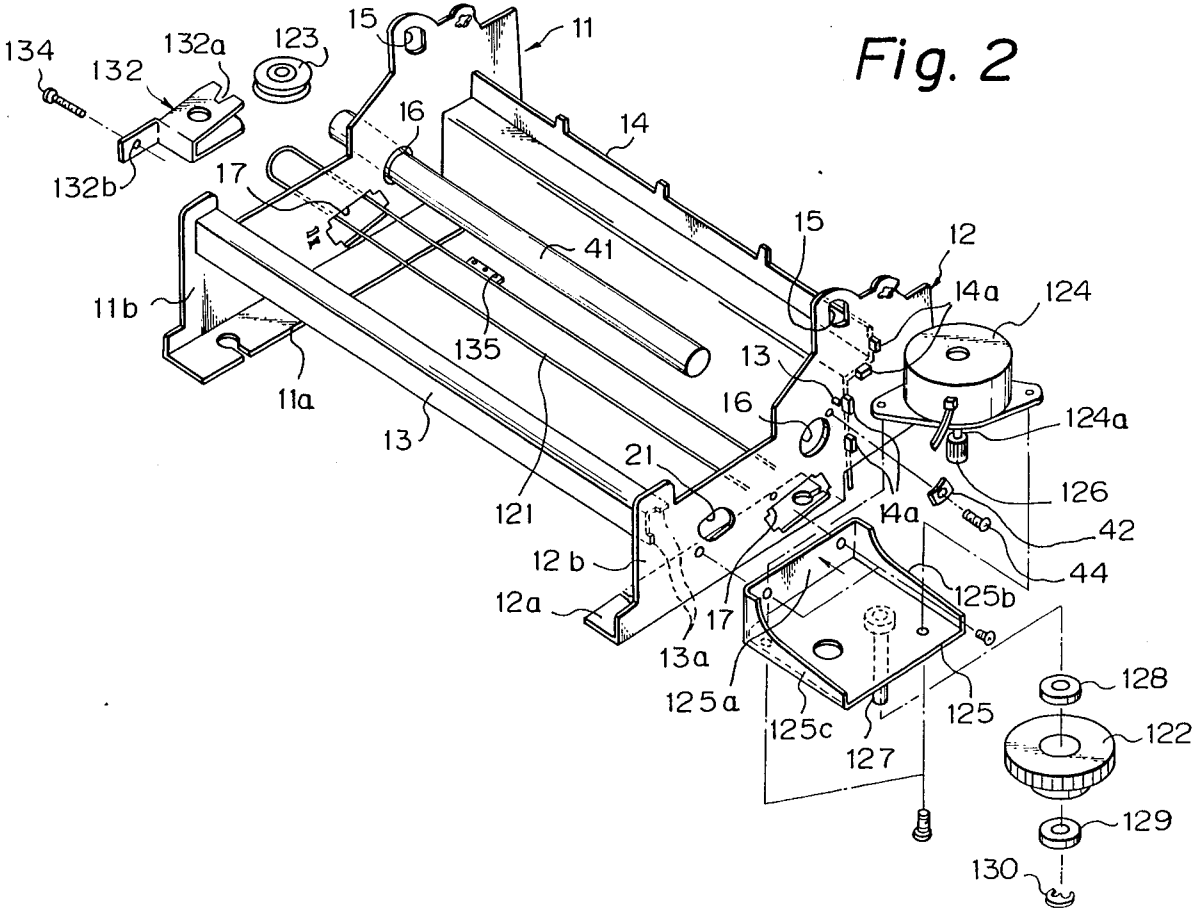
FIG. 2 is an exploded perspective view of various members which extend between side frames of the printing apparatus.
Figure 3:
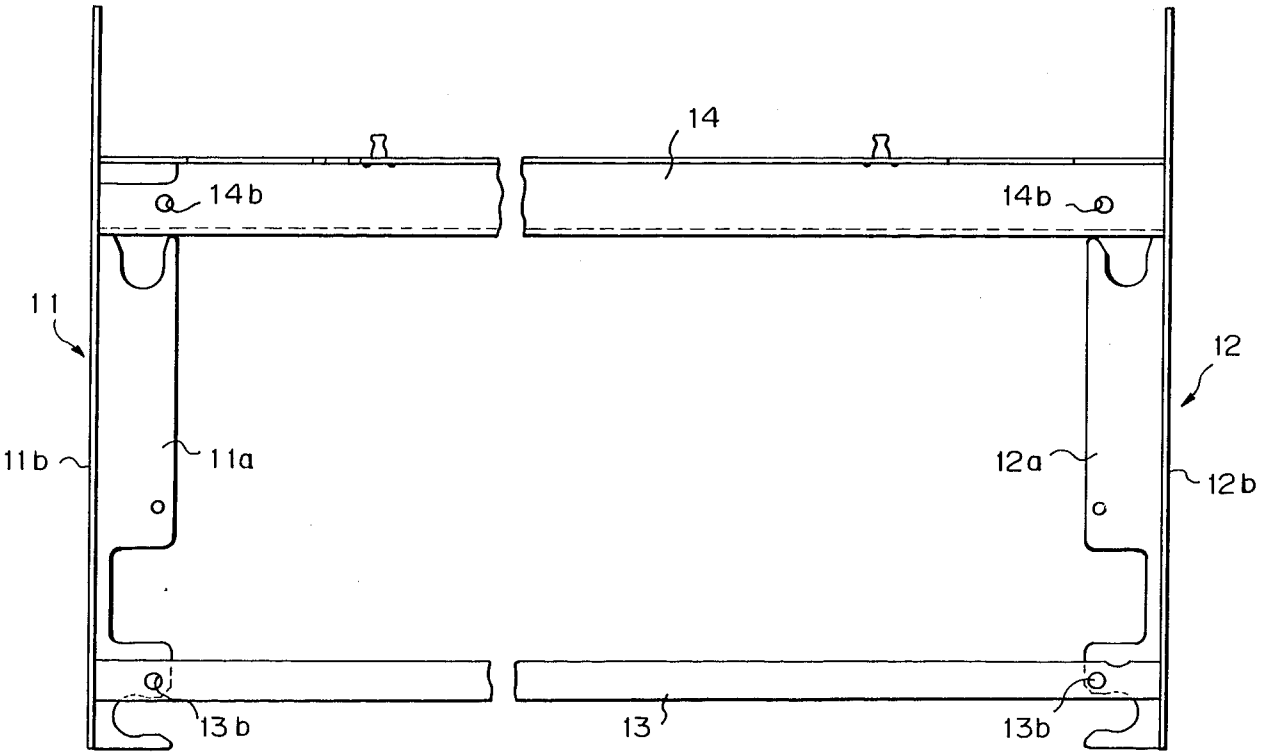
FIG. 3 is a plan view of a basic frameword of the printing apparatus.
Figure 4:
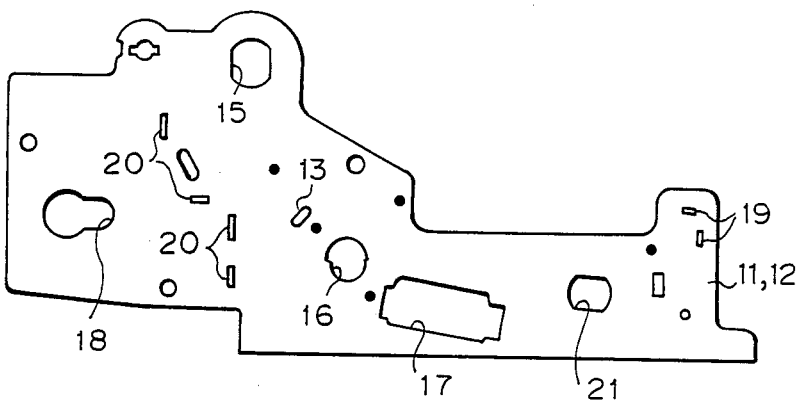
FIG. 4 is a side elevation of one of the side frames.

Referring to FIG. 1, a printer embodying the present invention and which is of the type using a type wheel is shown. The printer, generally 1, includes a top cover 2 mounted on a base cover, not shown, a front cover 3 detachably and openably mounted on the top cover 2, and a silencing cover 4 mounted on the front cover 3. As shown in FIGS. 2 to 4, side frames 11 and 12 are mounted on the base cover while a guide frame 13 and a stay 14 are provided between the side frames 11 and 12, whereby a framework inside the printer 1 is completed. The side frames 11 and 12 are provided with an identical configuration by press-forming and, then individually bent in an L-shape to have, respectively, a leg portion 11a and a wall portion **11*b* and a leg portion 12*a* and a wall portion 12*b*. The leg portions 11*a* and 12*a* are bent toward each other so that the side frames 11 and 12 serve as a left and a right side frame, respectively. Each of the side frames 11 and 12 is provided with an opening 16 for receiving a platen shaft, a slot 17 for receiving a pulley, an opening 18 for receiving the output shaft of a line feed motor, openings 19 for receiving lugs 13*a* which are provided on opposite ends of the guide frame 13, openings 20 for receiving lugs 14a which are provided on both ends of the stay 14, and an opening 21 for positioning which is used to assemble the side frames 11 and 12 and the guide frame 13 and stay 14. At least the openings 15 and 16** mentioned above are formed at the same time.

Figure 5:
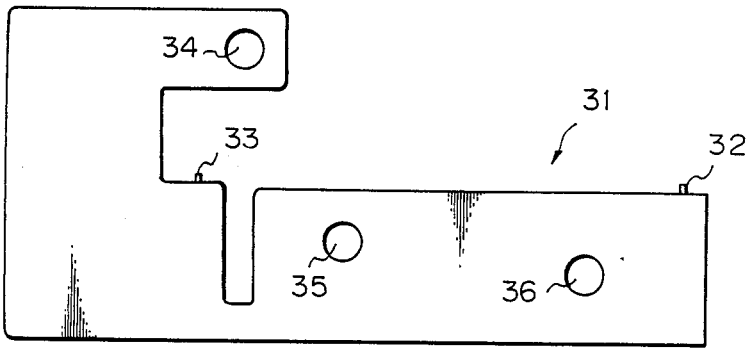
FIGS. 5 and 6, are, respectively, a side elevation and a perspective view of an assembling device which is used with the printing apparatus.
Figure 6:
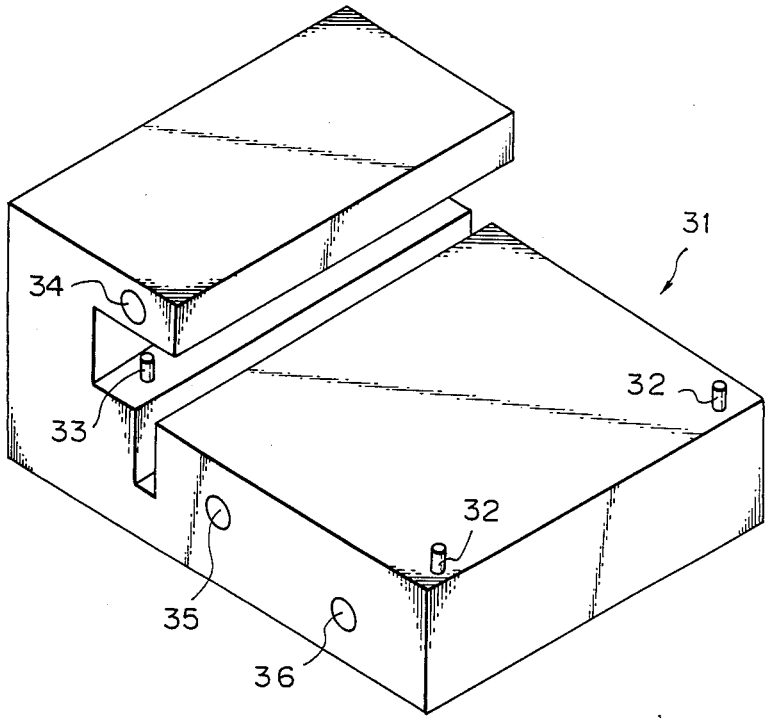

To assemble the side frames 11 and 12 and the guide frame 13 and stay 14 together, use is made of an assembling device 31 which is shown in FIGS. 5 and 6. Specifically, the guide frame 13 is produced by bending a sheet (e.g. bright material (SPCC-SB) whose surface is chemically treated) in an L-shape and formed with two apertures 13b for positioning, FIG. 3. The stay 14, on the other hand, is produced by bending a sheet (e.g. cold-rolled material plated with zinc) in a step-like configuration and provided with two openings **14*b* for positioning, FIG. 3. After the guide frame 13 and stay 14 have been loaded on the assembling device 31, a hydraulic mechanism built in the device 31 is driven to project positioning pins 32 and 33 from the device 31. Then, the pins 32 and 33 extend, respectively, throughout the apertures 13*b* of the guide frame and the apertues 14b of the stay 14 so as to position the guide frame 13 and the stay 14. Thereafter, the guide frame 13 and stay 14 are pressed against the platform of the device 31 by a pressing member such as a clamp plate, whereafter the side frames 11 and side frames 12 are mounted to both ends of the guide frame 13 and stay 14**.

Specifically, the lugs **13*a* of the guide frame 13 and the lugs 14*a* of the stay 14 are inserted, respectively, in the openings 19 and 20 of the side frames 11 and 12 to attach the side frames 11 and 12 to the guide frame 13 and stay 14. Then, three pins 34, 35 and 36 are hydraulically driven out of the assembling device 31 to penetrate, respectively, to the openings 15, 16 and 21 of the side frames 11 and 12. In this condition, the side frames 11 and 12 are pressed from the outside toward each other by a jig, not shown, whereby the lugs 13a and 14a protruding outward from the side frames 11 and 12 through the openings 19 and 20 are squeezed. As a result, the relative position of the side frames 11 and 12, guide frame 13 and stay 14 is determined with accuracy by the pins 32, 33, 34, 35 and 36 which protrude from the assembling device 31. Such enhances the accuracy of relative position without resorting to precision work otherwise needed for the assembly of such a framework, thereby improving printing accuracy and cutting down the cost of the printer 1**.

Figure 7:
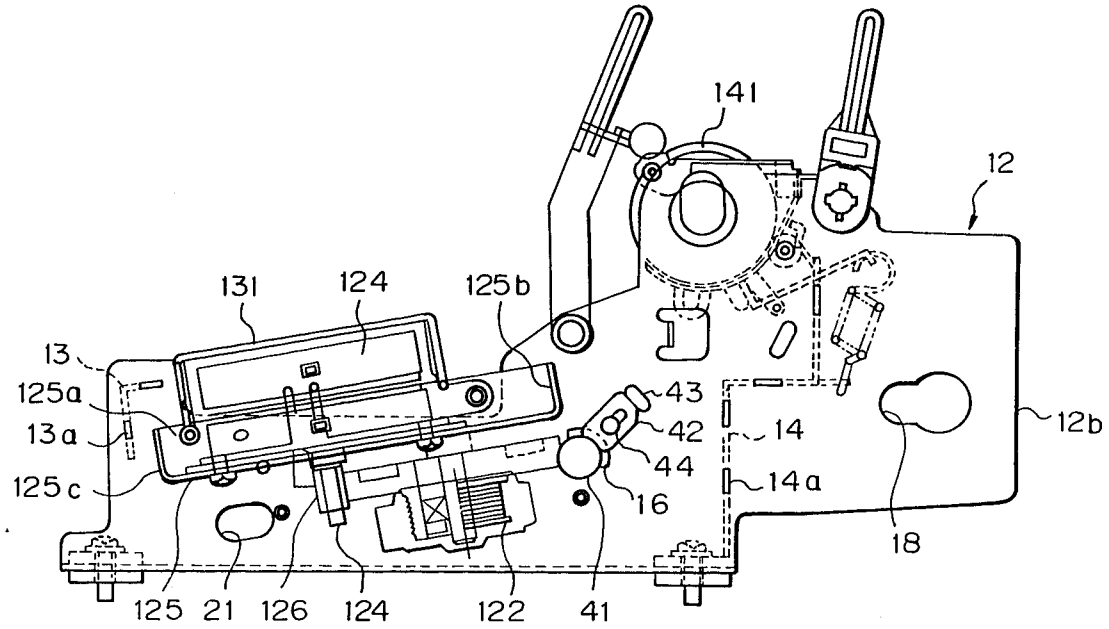
FIG. 7 is a side elevation of the right side frame.
Figure 8:
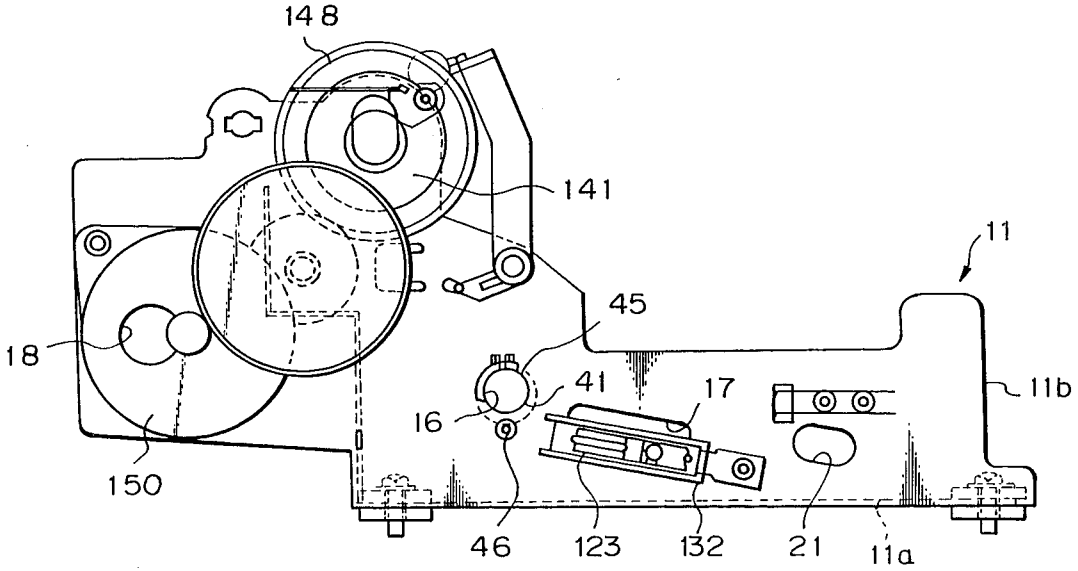
FIG. 8 is a side elevation of the left side frame.

A guide shaft 41 is provided between the side frames 11 and 12 and received in the openings 16 of the latter. Each of the openings 16 has a large diameter portion and a small diameter portion. As shown in FIG. 7, one end of a leaf spring 42 abuts against that end of the guide shaft 41 which protrudes from the side frame 12. The other end of the leaf spring 42 abuts against a stop in 43 which projects from the side frame 12. The intermediate portion of the leaf spring 42 is curved away from the side frame 12 and constantly urged toward the side frame 12 by a screw 44. Therefore, the guide shaft 41 is constantly biased by the leaf spring 42 toward the smaller diameter portion of the opening 16. As shown in FIG. 8, a C-ring 45 is fitted on that end of the guide shaft 41 which protrudes from the other side frame 11. The C-ring 45 is constantly biased by a screw 46 toward the smaller diameter portion of the opening 16 of the side frame 11. This structure allows the guide shaft 41 to be fixed to the side frames 11 and 12 without the need for recesses otherwise provided on the end portions of the guide shaft 41 by extra machining for receiving C-rings, thereby reducing the cost.

Figure 9:
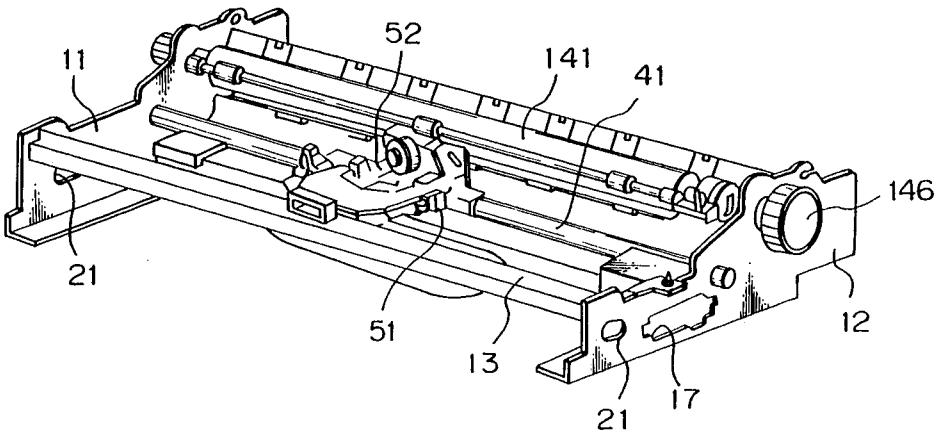
FIG. 9 is a perspective view of a printing mechanism included in the printing apparatus.
Figure 10:
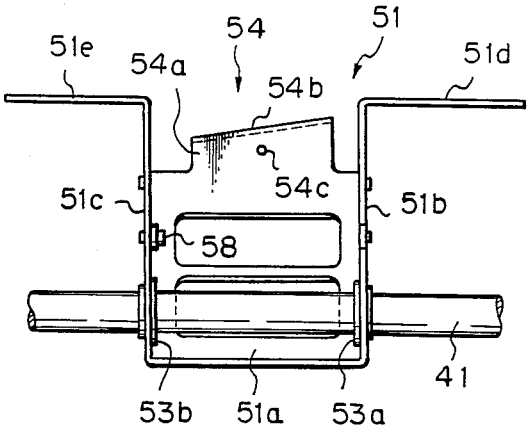
FIG. 10 is a front view of a carrier.
Figure 11:
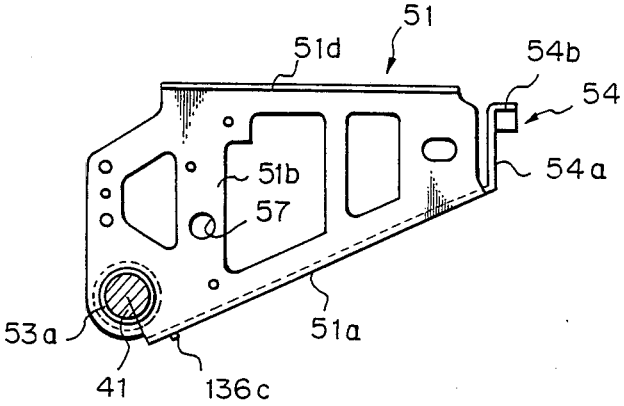
FIG. 11 is a side elevation of the carrier.
Figure 12:
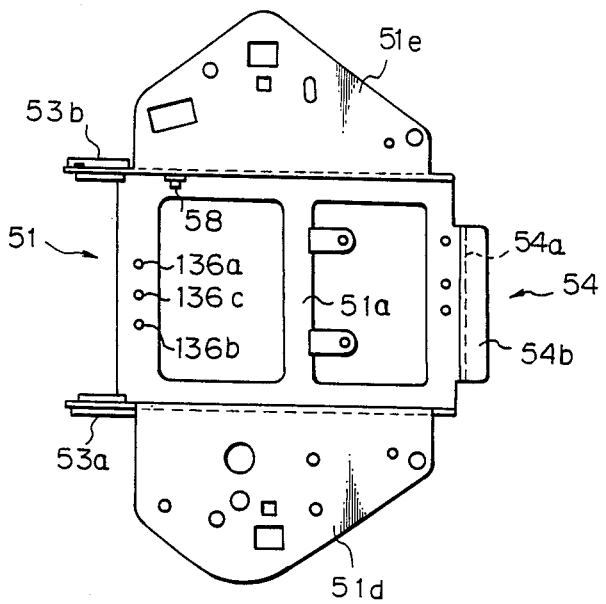
FIG. 12 is a plan view of the carrier.

As shown in FIG. 9, the guide shaft 41 and guide frame 13 serve as guide members on which a carrier 51 is slidably mounted, the carrier 51 supporting a carriage 52 in a rotatable manner. The carrier 51 is produced by press-forming a single sheet metal and, as shown in FIGS. 10, 11 and 12, provided with a bottom wall 51a, side walls **51*b* and 51*c*, and top walls 51*d* and 51*e*. Press-forming a single sheet metal minimizes secondary machining and, thereby, cuts down the cost. Bearings 53*a* and 53*b* are fitted, respectively, in the side walls 51*b* and 51*c* of the carrier 51. The carrier 51 is slidably mounted on the guide shaft 41 through the bearings 53*a* and 53*b*. The bottom wall 51*a* of the carrier 51 is provided at its rear end with a guide portion 54 which is made up of a vertical plate 54*a* and a guide plate 54*b* provided at the upper end of the vertical plate 54*a*. The guide plate 54*b* is inclinded at predetermined angle in the widthwise direction (lateral direction) of the carrier 51. The vertical plate 54*a* is provided with a screw hole 54*c***.

Figure 13B:
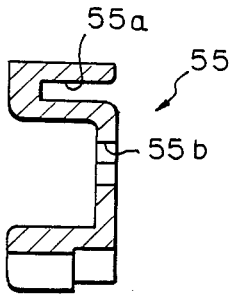
FIGS. 13A and 13B are, respectively, a front view and a sectional view of a slider.
Figure 13A:
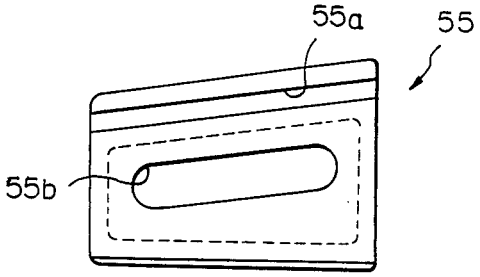

A slider 55, FIGS. 13A and 13B, is mounted on the guide portion 54 having the above configuration. Specifically, the slider 55 has a generally U-shaped section and includes a channel **55*a* for receiving the guide plate 54*b*, and a slot 55*b*, the channel 55*a* and slot 55*b* each being inclined by the same angle as the guide plate 54*b*. The slider 55 is fitted to the guide portion by inserting the guide plate 54*b* in the channel 55*a* and driving a screw, not shown, into the screw hole 54*c* through the slot 55*b*. The lower end of the slider 55 is placed on the upper end of the guide frame 13 to cause the guide frame 13 to support the rear end of the carrier 51. In this construction, when the position where slider 55 is mounted to the guide portion 54 is shifted along the slot 55*b*, the rear end of the carrier 51 is moved up and down relative to the guide frame 13 due to the inclination of the channel 55*a* and guide plate 54*b* and, consequently, the carrier 51 is rotated about the guide shaft 41**.

Produced by press-forming a sheet metal, the carriage 52 includes side walls **52*a* and 52*b* and a support wall 52*c*, as shown in FIG. 14. The side walls 52*a* and 52*b* are provided with apertures 56*a* and 56*b*, respectively. The carriage 52 is rotatably mounted on the carrier 51 by pins which are received in the apertures 56*a* and 56*b*, as will be described. As shown in FIGS. 11 and 14, the side wall 51b of the carrier 51 is formed with an opening 57 while, as shown in FIGS. 10, 12 and 14, the side wall 51*c* is provided with a stub 58 in face-to-face relation to the opening 57 by squeezing during the pressing step. This eliminates the need for secondary machining and, thereby, reduces the cost. To mount the carriage 52 to the carrier 51, the aperture 56*b* of the side wall 52*b* is mated with the stub 58 of the carrier 51 and, then, a pin 59 is inserted in the aperture 57 of carrier the side wall 51*b* and the aperture 56*a* of the carriage side wall 52*a***.

As shown in detail in FIG. 15, the pin 59 has small diameter portions **59*a* and 59*b* at opposite ends thereof, and a large diameter portion 59*c* between the small diameter portions 59*a* and 59*b*. One small diameter portion 59*a* of the pin 59 is inserted in the aperture 56*a* of the carriage 52, the large diameter or intermediate portion 59*c* is passed through the opening 57 of the carrier 51, and the other small diameter portion 59*b* is inserted in an aperture 60*a* of a leaf spring 60. The leaf spring 60 is fixed in place by driving a screw 62 into screw holes 60*b* and 61 which are formed through the leaf spring 60 and the side wall 51***b*, respectively. The leaf spring 60 in such a position constantly urges the pin 59 toward the side wall 52*a* resulting that the shoulder defined between the intermediate portion 59*c* and the end portion 59*a* of the pin 59 is abutted against the side wall 52*a*, whereby the carriage 52 is biased toward the side wall 51*c*. Hence, the carriage 52 is constantly biased toward the side wall 51*c* by the action of the leaf spring 60, preventing the carriage 52 from shaking. The stub 58 which is formed during press-forming of the carrier 51 effectively reduces the cost. In addition, since the stub 58 is provided with a stepped configuration, it prevents the side wall 52*b* from making contact with the side wall 51*c* and, thereby, allows the carriage 52 to be rotatably supported by the pin 59.

Figure 16:
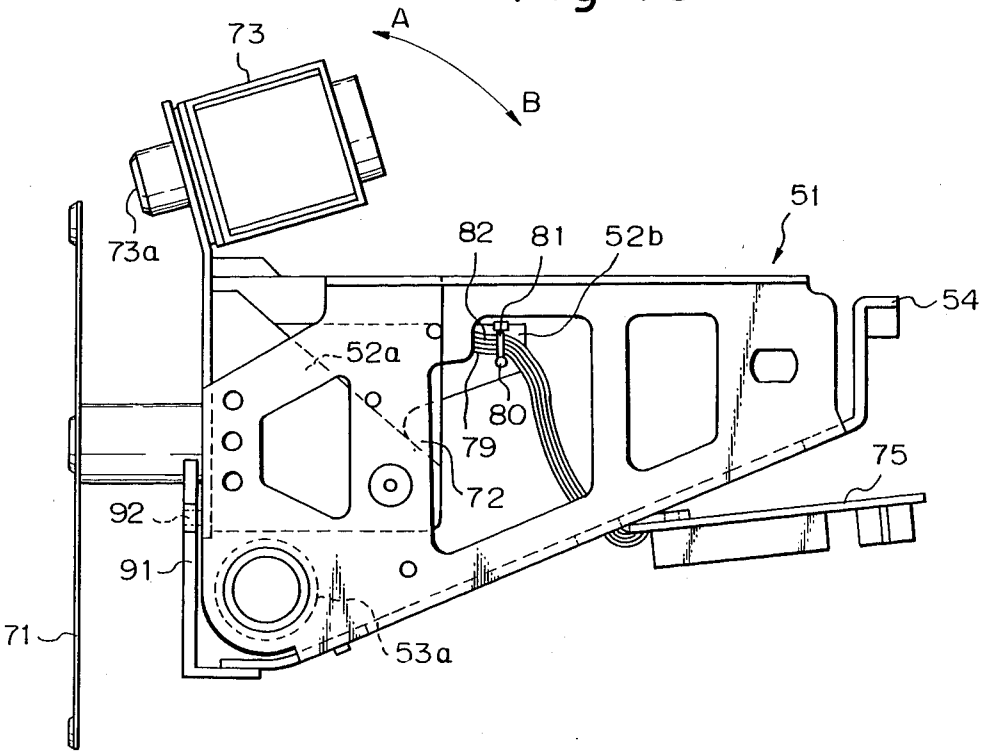
FIG. 16 is a side elevation also showing the carriage mounted on the carrier.
Figure 17:
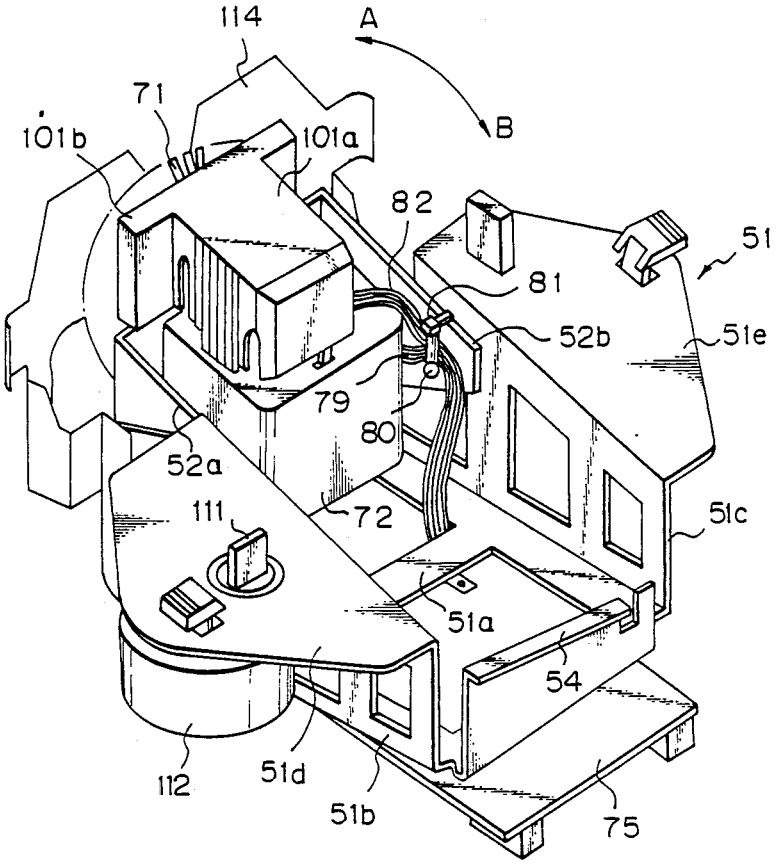
FIG. 17 is a perspective view also showing the carriage mounted on the carrier.
Figure 18:
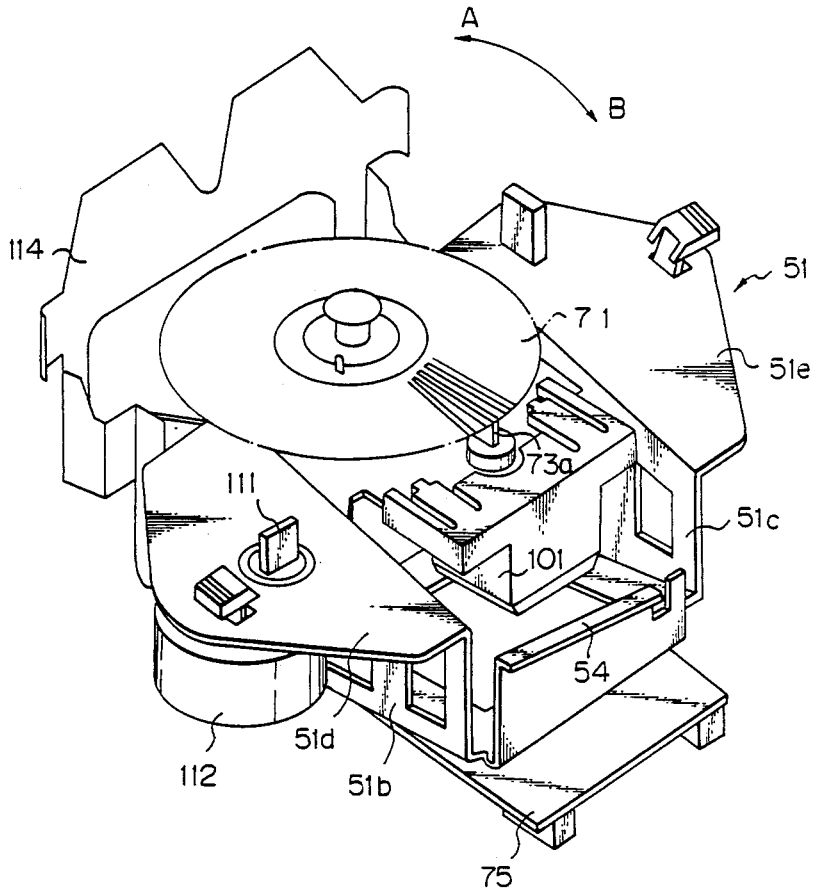
FIG. 18 is a perspective view of the carrier with the carriage held in a rearward rotated position.

As shown in FIGS. 16 to 18, the carriage 52 is loaded with a type wheel 71 which is provided with types on the tips of its fingers as well known in the art, a selection motor 72 for rotating the type wheel 71, a hammer solenoid 73 for hammering a selected one of the types of the type wheel 71, and other various members which constitute a printing mechanism. The carriage 52 is supported by the carrier 51 in such a manner as to be rotatable in directions A and B as indicated by a double-headed arrow (forward and rearward). To replace the type wheel 71, the carriage 52 is rotated in the direction B. Specifically, the carriage 52 is movable between a print position (FIGS. 16 and 17) where the carriage 52 assumes a substantially vertical position, and a replace position (FIG. 18) set up by rotating the carriage 52 by substantially 90 degrees in the direction B and where the type wheel 71 faces substantially vertically upward. This allows one to easily remove the type wheel 71 from and attach it to the output shaft of the selection motor 72, thereby promoting the ease of replacement of the type wheel 71.

Figure 19:
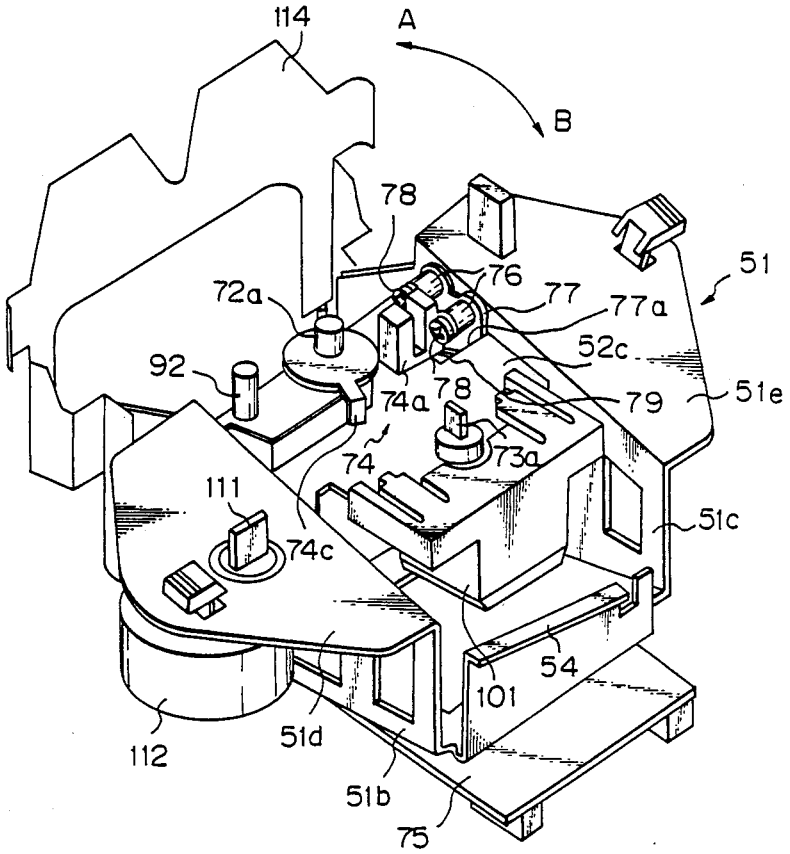
FIG. 19 is a view similar to FIG. 18, showing the carrier from which a type wheel is removed.
Figure 20:
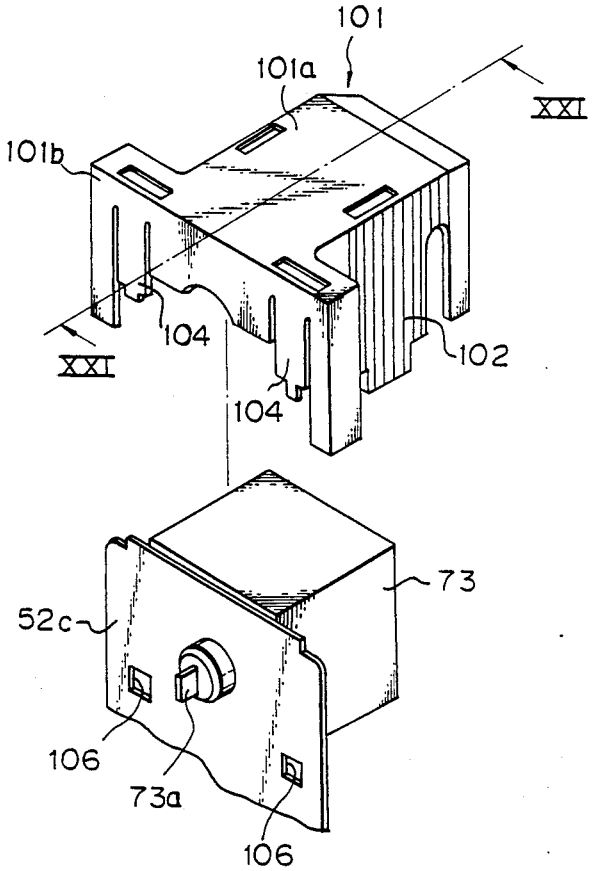
FIG. 20 is a perspective view of a hammer cover which is attached to a support plate of the carriage.

Such a substantial range of angular movement of the carriage 52 is realized by the following implementations: increasing the depth of a recess defined by the bottom wall 51*a* and side walls 51*b* and 51*c* of the carrier 51, mounting a home position sensor means 74, FIG. 19, on the front surface (adjacent to the platen) of the carriage suppport wall 52*c* for sensing the home position of the type wheel 71, mounting on the back of the bottom wall 51*a* a base plate which is loaded with the selection motor 72, hammer solenoid 73 and other electrical driving elements, and using a stepping motor for the selection motor 72. The home position sensor means 74 comprises a light-emitting and a light-receiving element which are mounted face-to-face on a generally U-shaped support member 74*a*. The light-emitting and light-receiving elements are adapted to sense a shutter piece 74*c* of a setter 74*b* which serves to position and fix the type wheel 71, which is loaded on the tip of the output shaft 72*a* of the selection motor 72. The support member 74*a* is mounted to the carriage support wall 52*c* through a spacer 76. Specifically, the support wall 52*c* is provided with cuts and raised along the cuts perpendicularly to form a support piece 77, which leaves a window 77*a* in the support wall 52*a*. The setter, or support member, 74*a* is fastened to the support piece 77 by a screw 78 through the spacer 76. Electrical wirings 79 which are connected to the photosensor on the support member 74*a* are brought to the rear side of the support wall 52*c* through the window 77*a*. Therefore, it is needless for the wirings 79 to be arranged above or below the support wall 52*c*, otherwise the wirings 79 would interfere with the rotation of the carriage 52 and with other members such as the type wheel 71.

As shown in FIGS. 16 and 17, the side wall 52*b* of the carriage 52 which is closer to the support piece 77 than the side wall 52*a* extends over a substantial length to the rear of the carriage 52 so that, when the carriage 52 is rotated by substantially 90 degrees in the direction B, the side wall 52*b* may abut against the bottom wall 51*a* of the carrier 51 to stop the carriage 52. The side wall 52*b* is provided with an opening 80 at its end portion. A fastening member 81 is passed through the opening 80 to collectively fix the wirings 79 and those wirings 82 associated with the selection motor 72 and hammer solenoid 73 to the side wall 52*b*, the wirings 79 and 82 being guided to the base plate 75 which is mounted on the bottom plate 51*a*. In this construction, even when the carriage 52 is rotated, the wirings 79 and 82 are prevented from being caught by the selection motor 72, hammer solenoid 73 and others to promote efficient replacement of the type wheel 71 and others.

While the carriage 52 is returned in the direction A toward the print position after the replacement of the type wheel 71, a catcher 91, FIG. 16, which is mounted on the carrier 51 catches a catch bar 92 which is provided on the carriage 52, thereby limiting the angular movement of the carriage 52 in the direction A. In the print position, the hammer solenoid 73 drives a hammer 73*a* to strike it against a selected one of the types of the type wheel 71 to thereby print out a character or the like. In this instance, the printing accuracy is effected by the oscillation of the carriage 52 in the up-down and right-left directions. As regards the oscillation in the up-down direction, it is surely prevented by the side walls 52*a* and 52*b* of the carriage 52 which are abutted against the bearings 53*a* and 53*b*, and the catcher 91 which is engaged with the catch bar 92. The printing height is determined by the abutment of the side walls 52*a* and 52*b* of the carriage 52 against the upper ends of the bearings 53*a* and 53*b*. That is, while the print position is determined with the upper ends of the bearings 53*a* and 53*b* used as a reference, the print position is highly accurate because the carrier 51 and carriage 52 are produced by press-forming each and because the bearings 53*a* and 53*b* are mounted on the carrier 51. Therefore, it is needless to provide an extra mechanism for determining a printing height which would add to the cost. The oscillation in the right-left direction, too, is surely eliminated by the force of the spring 65 and the rigidity of the carriage 52, i.e., because the carriage 52 is biased in one direction by the leaf spring 65 and because the carriage 52 is produced by press-forming a sheet metal. This not only enhances accurate printing but also cuts down the cost.

Figure 21A:
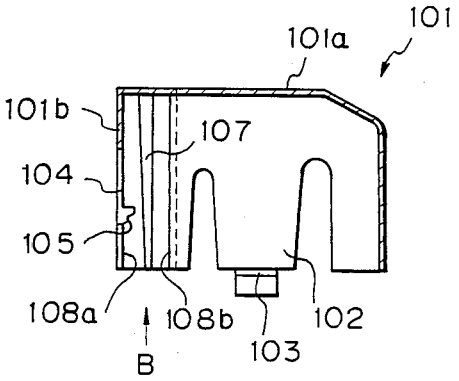
FIG. 21A is a section as seen in a direction of arrow XXI-XXI of FIG. 20.
Figure 21B:
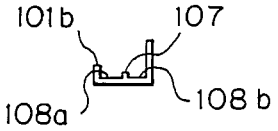
FIG. 21B is a view as seen in a direction of arrow B of FIG. 21A.

A hammer cover 101, FIGS. 21A and 21B, is removably attached to the hammer solenoid 73. The hammer cover 101 includes a body 101*a* and a flange 101b which extends from both sides of the body 101*a*. Tongues 102 extend downward from the body 101*a* at both side wall portions of the latter while a lug 103 is provided on the inner surface of a lower end portion of each tongue 102. Likewise, two tongues 104 extend downward from the flange 101*b* at a front wall portion of the latter while a lug 105 is provided on the inner surface of a lower end portion of each tongue 104. The body 101*a* is attached to the hammer solenoid 73, and the lugs 103 of the tongues 102 are engaged with the bottom of the hammer solenoid 73. The flange 101*b* is attached to the support wall 52*c* of the carriage 52 with the lugs 105 of the tongues 104 received in apertures 106 of the support wall 52c. As shown in FIGS. 21A and 21B, each of both side wall portions of the flange 101b is provided on its inner surface with an elongate lug 107 which extends in the up-down direction of the flange 101b. The elongate lug 107 defines two channels 108a and 108b the inner surface of its associated flange side wall portion. The channels 108a adjacent to the tongues 104 are individually sequentially narrowed toward the upper end and adapted to receive both side edges of the support wall 52c. The hammer cover 101 having such a configuration is attached to the hammer solenoid 73 and support wall 52c by the lugs 103 and 105, while holding the support plate 52c with the lugs 107 and the front wall portion of the flange 101b. In this manner, the hammer cover 101 is fitted to the hammer solenoid 73 and support wall 52 firmly without shaking. The hammer cover 101 is made of resinous nylon for molding (e.g. noncombustible UL94). The width of the channels 108a is selected such that the strain ratio of the lugs 197 due to the penetration of the support wall 52c into the channels 108a remains smaller than the yield range which is determined by the resin used, the width of the channels 108a, etc.

One can rotate the carriage 52 by holding the hammer cover 101 which is made of heat-resisting resin as stated above, i.e., without touching the hammer solenoid 73. This ensures safety operation of the printer 1. It is to be noted that the lugs 105 and 107 of the hammer cover 101, which serve as means for fixing the hammer cover 101 to the support wall 52c, may be replaced with simple projections which are provided on the front side walls of the flange 101b with their height sequentially increased toward the upper end.

In FIGS. 17 to 19, a ribbon cartridge is loaded on the top walls 51d and 51e of the carrier 51 and driven by a drive piece 111 of a ribbon feed gear, which is rotatably mounted on the top wall 51d. The ribbon feed gear is in turn driven by a ribbon feed motor 112 which is mounted on the top wall 51d. Further, a paper holder 114 is provided on the carrier 51 and produced by press-forming a stainless steel sheet.

Figure 22:
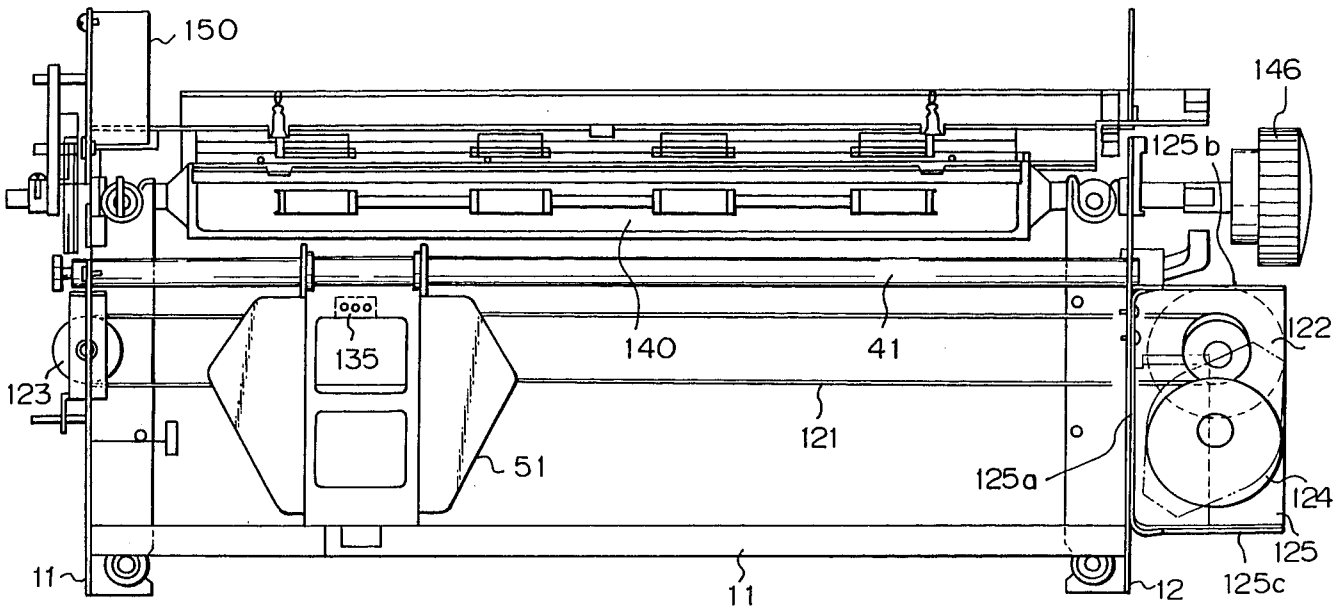
FIG. 22 is a plan view of the printing mechanism.

As shown in FIG. 22, the carrier 51 is connected to a space wire 121 to be moved thereby along the guide shaft 41 and guide frame 11. The space wire 121 is guided by a gear pulley 122 and a side pulley 123. The gear pulley 122 is driven by a space motor 124 to drive the space wire 121. As shown in FIGS. 2 and 7, the space motor 124 having a flat configuration is mounted on a bracket 125 in a horizontal position such that its output shaft extends in substantially the up-down direction of the printer 1. This reduces the overall height of the printer 1, compared to a prior art printer wherein such a motor is mounted in a vertical position. The bracket 125 is produced by pressforming a sheet metal and, as shown in FIG. 2, provided with bent portions 125a, 125b and 125c at three sides thereof. When the bent portion 125a is mounted on the side frame 12, the other bent portions 125b and 125c are located at both sides of the mounting position, increasing the bending rigidity of the bracket 125 in the up-down direction. A pinion 126 is mounted on the output shaft 124a of the space motor 124.

Figure 23:
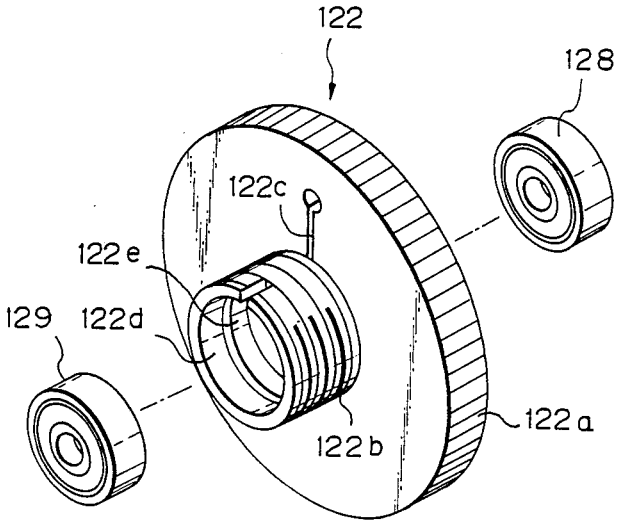
FIG. 23 is a perspective view of a gear pulley and bearings which are fitted in the gear pulley.
Figure 24:
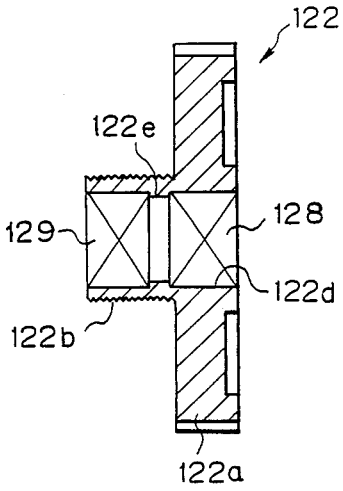
FIG. 24 is a section of the gear pulley.
Figure 25:
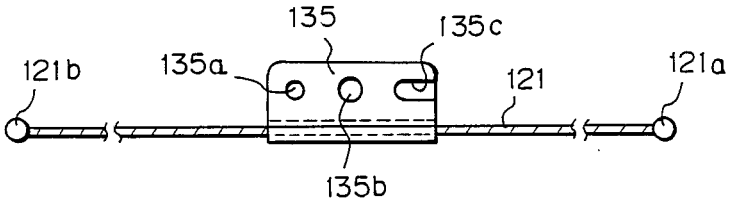
FIG. 25 is a front view of a space wire and a fixing plate which is rigidly connected to the space wire.

A shaft 127 is fixed to the bracket 125 by riveting while a gear pulley 122 is mounted on the shaft 127 through two bearings 128 and 129. As shown in FIGS. 23 and 24, the gear pulley 122 is provided with a toothed portion 122a which meshes with the pinion 126, a lead portion 122b around which the space wire 121 is wound, and a slot 122c in which the space wire 121 is inserted. Specifically, as shown in FIG. 25, the space wire 121 has balls 121a and 121b at both ends thereof so that the space wire 121 inserted in the slot 122c is prevented from slipping off the slot 122c by the balls 121a and 121b. The gear pulley 122 is provided with a bore 122d for the receiving bearings 128 and 129, an annular projection 122e being positioned in an intermediate portion of the bore 122d. After the bearings 128 and 129 have been inserted in the bore 122d, the shaft 127 is inserted in the openings of the bearings 128 and 129. Then, an E-ring 130, FIG. 2, is fitted on the shaft 127 in contact with the underside of the lower bearing 129. The gear pulley 122 is mounted to the shaft 127 through the projection 122e by the bearing 129 which is retained by the E-ring 130. This makes it needless for the bearings 128 and 129 to be press-fitted in the bore 122d of the gear pulley 122 to be rigidly connected to the latter, whereby the increase in the diameter of the lead portion 122b is prevented. It follows that the amount of feed of the carrier 51 can be controlled with accuracy by controlling the angular position of the bore 122d, enhancing accurate printing.

Figure 26:
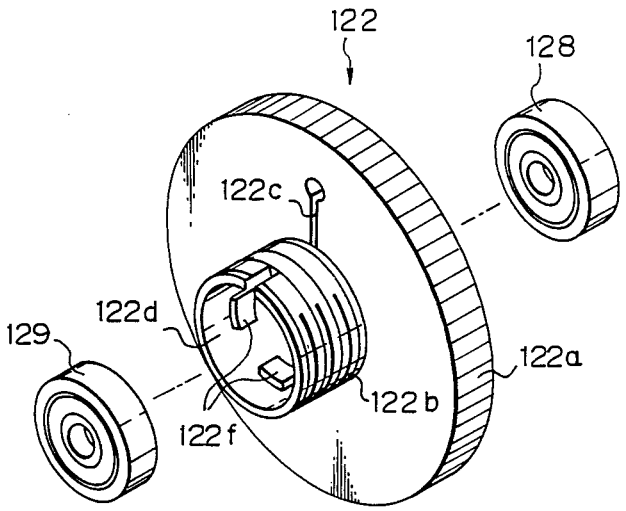
FIG. 26 is a view similar to FIG. 23, showing a modification to the gear pulley of FIG. 23.

As shown in FIG. 26, the annular projection 122e may be replaced with a plurality of spaced projections 122f which are arranged in an annular configuration. As shown in FIG. 7, a motor cover 131 is attached to the space motor 124 in order to promote safety operation of the printer 1.

While the bent portions 125b and 125c of the bracket 125 have been shown and described as being bent toward the space motor 124, they may be bent toward the gear pulley 122. In such an alternative configuration, when the tension of the space wire 121 acts on the gear pulley 122 tending to bend the bracket 125 toward the gear pulley 122, the bent portions 125b and 125c are brought into abutment against the side frame 12 to provide the bracket 125 with further rigidity.

A side pulley 123 is mounted on the side frame 11. As shown in FIGS. 2 and 8, the side pulley 123 is rotatably mounted on a bracket 132 which is produced by press-forming a sheet metal. As shown in FIG. 2, the bracket 132 is provided with a recess 132a at its end. The bracket 132 is received in the slot 17 of the side frame 11 which is adapted to mount the side pulley 123. The bracket 132 is mounted to the side frame 12 by inserting the end portion of the bracket 132 in a rear narrowed portion of the slot 17, then inserting the side frame 11 in the recess 132a of the bracket 132, and then driving adjusting screw 134 into a screw hole 132b of the bracket 132 until the tip of the adjusting screw 134 abuts against the side frame 11. The bracket 132 which is produced by press-forming a sheet metal as stated above contributes to the cut-down of cost of the printer 1.

The space wire 121 is wound around the lead portion 122b of the gear pulley 122 with its balls 121a and 121b inserted in and retained by the slot 122c, while being stretched between the gear pulley 122 and the side pulley 123. The tension of the space wire 121 is adjustable by operating the adjusting screw 134. The carrier 51 is connected to the space wire 121. The connection of the space wire 121 and carrier 51 has customarily been set up by, for example, winding the space wire 121 around the lead portion 122b of the gear pulley 122 by a predetermined number of turns and, then, connecting the space wire 121 and carrier 51 by means of a fixing plate with the carrier 51 placed in its home position. Such a procedure is troublesome and inefficient because the space wire 121 has to be wound around the lead portion 122*b* by a predetermined number of times and connected to the wire with the carrier 51 held in the home position. So long as the position where the space wire 121 is to be connected to the gear pulley 122 is determined, the position where the carrier 51 is to be connected to the space wire 121 is determined. In this respect, the connecting position of the space wire 121 to the gear pulley 122 in accordance with this embodiment remains constant because the space wire 121 is connected to the gear pulley 122 with its balls 121*a* and 121*b* inserted in the lead portion 122*b* of the gear pulley 122.

As shown in FIG. 25, a fixing plate 135 is mounted on a predetermined position of space wire 121 beforehand and, then, this plate 135 is connected to the carrier 51. Specifically, the fixing plate 135 is provided with two openings 135*a* and 135*b* and a slot 135*c*. On the other hand, as shown in FIGS. 11 and 12, the carrier 51 is provided with two screw holes 136*a* and 136*b* and a lug 136*c* which protrudes downward from the carrier 51. The fixing plate 135 is fixed to the space wire 121 by riveting at a position which is distant by a predetermined amount as measured from the inner ends of the balls 121*a* an 121*b*, and the opening 135*b* of the plate 135 is mated with the lug 136*c* of the carrier 51. Thereafter, screws are driven into the screw holes 136*a* and 136*b* through the openings 135*a* and 135*c* to fix the fixing plate 135 to the carrier 51, whereby the space wire 121 is connected to the carrier 51 through the plate 135. In this manner, the space wire 121 and carrier 51 are connected together easily and efficiently. Further, since the fixing plate 135 is mounted on the accurate position of the space wire 121, the carrier 51 can be mounted to the space wire 121 with sufficient positional accuracy.

Figure 27:
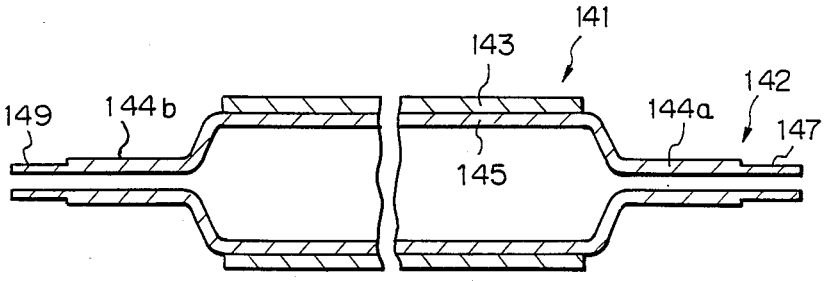
FIG. 27 is a section of a platen.

The platen 141 is rotatably supported by the side frames 11 and 12 and, as shown in FIG. 27, made up of a tubular member 142 and an elastic member 143. The tubular member 143 comprises a tube made of aluminum or aluminum alloy and includes shaft portions 144*a* and 144*b* which are formed by swaging both ends of the tube. The elastic member 143, on the other hand, comprises an extrusion of rubber which is pressfitted on a shank portion 145 of the tubular member 142 and, then, has its surface ground. Since the surface of the elastic member 143 is ground with the tubular member 143 supported at its shaft portions 144*a* and 144*b* and rotated, the elastic member 143 is not only provided with a smooth surface but also rendered coaxial with the shaft portions 144*a* and 144*b*. The shaft portion 144*a* is provided with recesses 147 for mounting a platen knob 146 (see FIGS. 1, 9 and 22) at its end. The other shaft 144*b* is provided with recesses 149 for mounting a platen gear 148 (see FIGS. 8 and 22). These recesses 147 and 149 are formed during swaging of the tubular member 142. As stated above, since the platen 141 is made up of the swaged tubular member 142 and elastic member 143, not only an accurate coaxial configuration is achieved but also the production is easy and economical. In addition, the tubular member 142 which is implemented with an aluminum or like tube is light enough to promote the use of a motor whose output torque is relatively small for a line feed motor 150 (see FIGS. 8 and 22). Consequently, the cost of the printer 1 is reduced.

It is to be noted that while the platen 141 is swaged, it is needless for the diameter to be sharply reduced from the shank portion 145 to the shaft portions 144*a* and 144*b*, i.e., the diameter may be reduced stepwise so as to provide a certain angle of inclination between the shank portion 145 and the shaft portions 144*a* and 144*b*. Such an alternative swaging procedure is effective to increase the rigidity of the intermediate sections between the shank portion 145 and the shaft portions 144a and 144*b*, compared to a procedure wherein the diameter is sharply reduced, and thereby allows a tube whose wall is thin to be used for the tubular member 142. This further enhances the decrease in the weight and cost of the platen 141. The platen 141 is rotatably supported by the side frames 11 and 12 with its shaft portions 144*a* and 144*b* received, respectively, in the openings 15 of the side frames 11 and 12.

Figure 28:
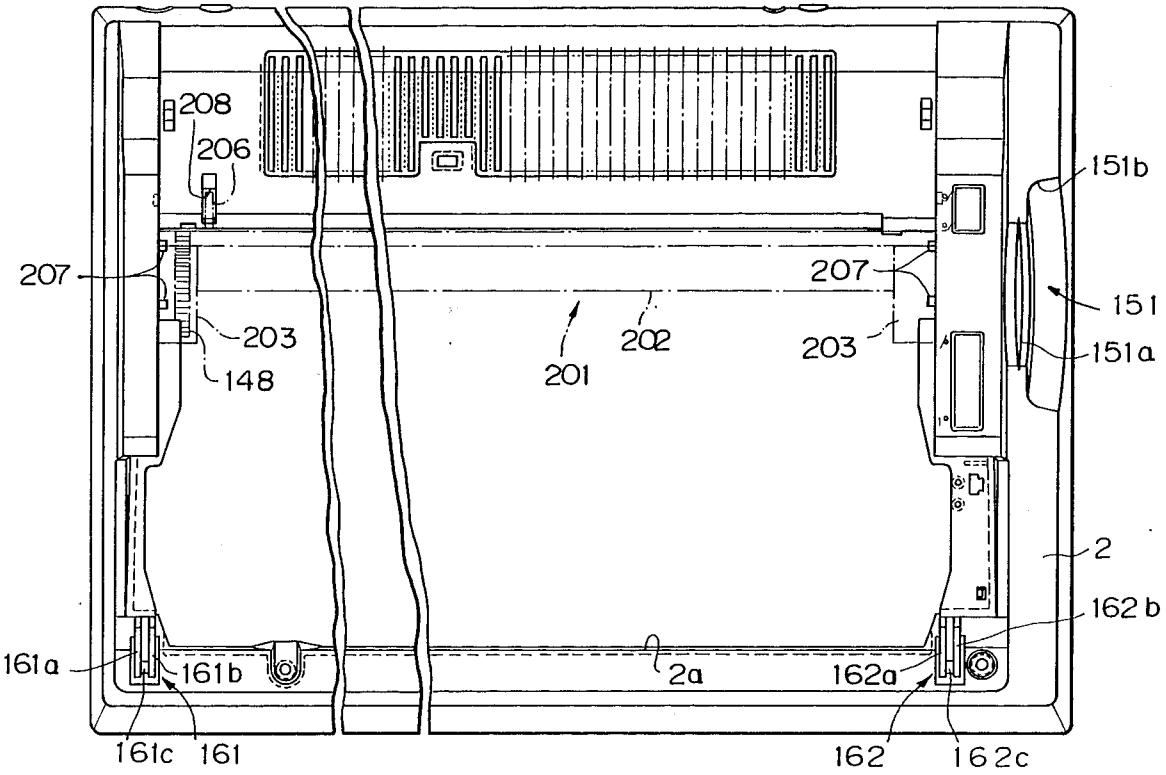
FIG. 28 is a plan view of a top cover.
Figure 29:
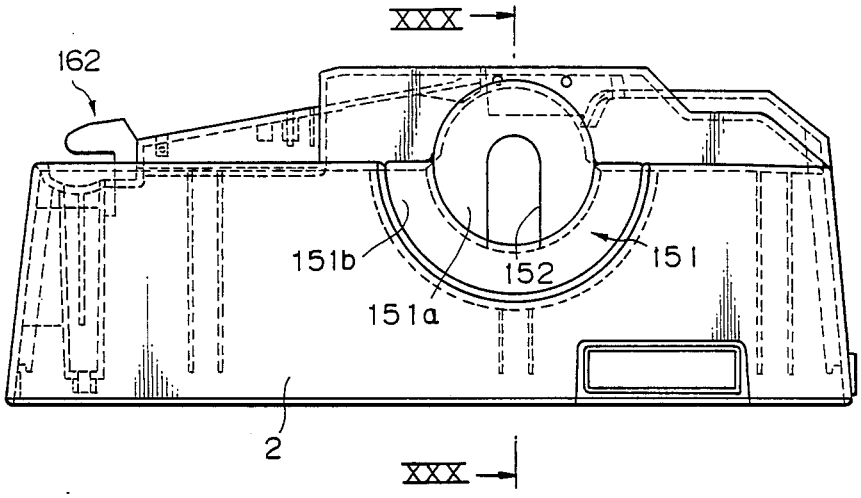
FIG. 29 is a side elevation of the top cover.
Figure 30:
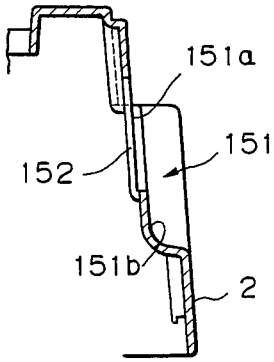
FIG. 30 is a section as seen in a direction of arrow XXX—XXX OF FIG. 29.
Figure 31:
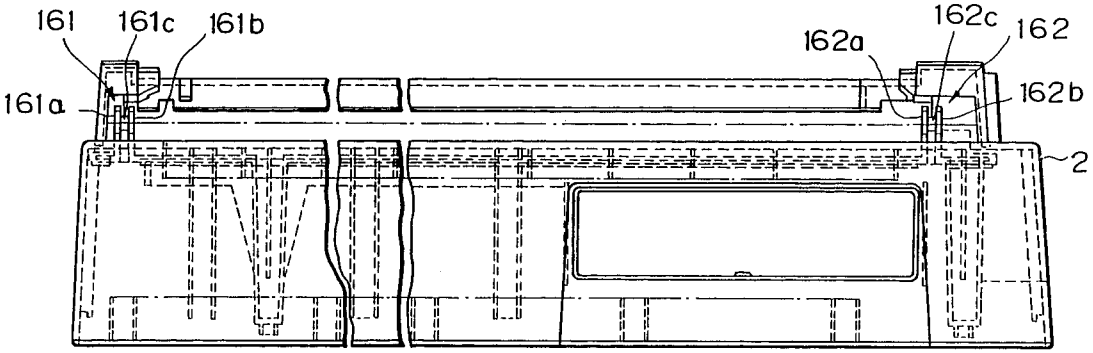
FIG. 31 is a rear view of the top cover.

Mounted to cover the printing mechanism described above, the top cover 2 is provided with a recess 151 in its right wall in order to accommodate the platen knob 146. As shown in FIGS. 28 to 30, the bottom 151*a* of the recess 151 is further recessed and provided with an opening 152 for receiving a shaft portion 146*a* of the platen knob 146. The opening 152 extends downward to terminate at the lower end of the bottom 151*a* of the recess 151 which is further recessed from a wall 151*b*. The top cover 2 is produced by the injection molding of nolyl resin or the like, a mold being moved in the up-down direction of the top cover 2. Since the opening 152 is allowed to open downward by the stepwise configuration of the bottom 151*a* and the wall 151*b* of the recess 151, the mold for providing the opening 152 can be moved in the up-down direction of the top cover 2. This eliminates the need for an extra mold which is to be moved in the transverse direction of the top cover 2, thereby promoting economical and easy production of the top cover 2. As shown in FIGS. 28, 29 and 31, a pair of brackets 161 and 162 are provided on the front upper end of the top cover. The bracket 161 includes a pair of arm portions 161a and 161*b* protruding upward from the upper end of the top cover 2, and a shaft portion 161*c* interposed between the arms 162*a* and 162*b*. Likewise, the bracket 162 includes a pair of arm portions 162*a* and 162*b*, and a shaft portion 162*c* which are identical in configuration with the arm portions 161*a* and 161*b* and the shaft portion 161*c*, respectively.

Figure 32:
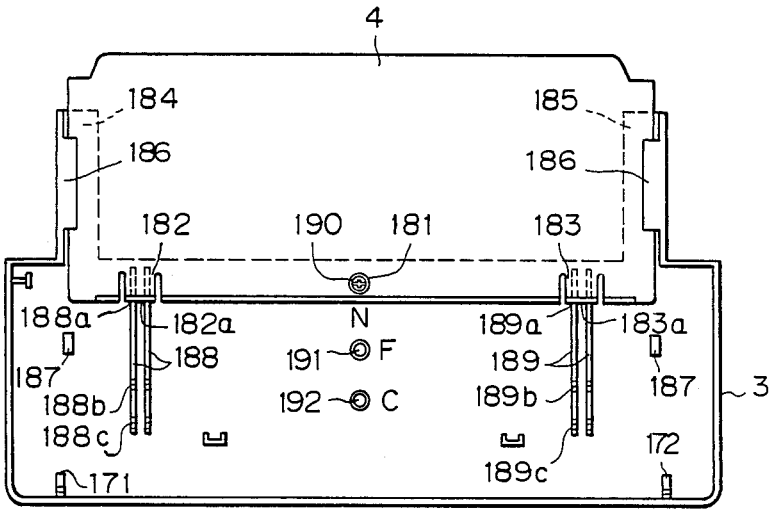
FIG. 32 is a rear view of a front over and a silencing cover.

As shown in FIG. 32, a pair of hook portions 171 and 172 are provided on the rear surface of the front cover 3 to correspond in position, respectively, to the brackets 161 and 162 of the top cover 2. The hook portions 171 and 172 have recesses which are adapted to receive, respectively, the shaft portions 161*c* and 162*c* of the brackets 161 and 162. To attach the front cover 3 to the top cover 2, the hook portions 171 and 172 are placed, respectively, between the arms 161*a* and 161*b* and between the arms 162*a* and 162*b*, and the shaft portions 161*c* and 162*c* are inserted in the recesses of the hook portions 171 and 172, respectively. This allows the front cover 3 to be detachably and rotatably mounted to the top cover 2 through the hook portions 171 and 172 and the brackets 161 and 162.

As shown in FIGS. 32, the silencing cover 4 which is made of transparent resin is mounted to the front cover 3 to extend rearward from the latter. The front cover 3 and silencing cover 4 cooperate to close a top opening 2*a*, FIG. 28, of the top cover 2 to silence the printing noise while allowing one to see the printing conditions through the cover 4. Having a generally rectangular shaped, the silencing cover 4 is provided with an opening 181 at its front intermediate portion for mounting the cover 4 to the cover 3. Tongues 182 and 183 are provided in a front end portion of the silencing cover 4. The front ends of the tongues 182 and 183 terminate, respectively, at elongate lugs 182*a* and 183*a* which individually extend toward the front cover 3. A pair of guide portions 184 and 185 extend rearward from the silencing cover 4 in both side edge portions of the latter. Provided in those guide portions 184 and 185 are guide members 186, and provided on the back of the front cover 3 are guide members 187. The guide members 186 and 187 cooperate to guide both side edge portions of the silencing cover 4. Further, guide rails 188 and 189 are provided on the back of the front cover to project toward the silencing cover 4 to engage with the projections 182*a* and 183*a* of the tongues 182 and 183, respectively. The guide rails 188 are provided with three recesses 188*a*, 188*b* and 188*c*, and the guide rails 189 are provided with three recesses 189*a*, 189*b* and 189*c*. The recesses 188*a* and 189*a*, 188*b* and 189*b*, and 188*c* and 189*c* with which the projections 182*a* and 183*a* are selectively engageable by sliding the silencing cover 4 define, respectively, a position N where no optional unit is mounted on the printer 1, a position F where a form tractor is mounted, and a position C where an auto sheet feeder is mounted. When the projections 182*a* and 183*a* are received in any of the aligned recesses 188*a* and 189*a*, 188*b* and 189*b*, and 188*c* and 189*c*, a screw is driven into one of screw holes 190, 191 and 192 associated with the recesses through the opening 181 of the silencing cover 4, thereby fixing the silencing cover 4 to the front cover 3. In this construction, the silencing cover 4 can be moved to an adequate position easily and adequately to accommodate a desired optional unit such as a form tractor or an auto sheet feeder.

When the top cover 2 is mounted on the printer 1, the platen gear 148 shows itself through the top opening 2*a* of the top cover 2. This gear 148 serves to drive a form tractor or an auto sheet feeder when the later is used, and is needless when such an optional unit is not used. If the platen gear 148 is exposed when the operator opens the front cover 3, it is apt to injure the operator. For this reason, the platen gear 148 has to be provided with a cover, and this cover has to be removed when a form tractor or the like is used. On the other hand, when the front cover 3 is closed with no optional unit mounted on the printer 1, a clearance is left between the rear end of the silencing cover 4 and the top cover 2. This clearance is adapted to guide a recording paper into and out of the printer 1. Although such a clearance should be as narrow as possible from a silencing standpoint, an excessively small clearance would not only render the ingress and egress of a recording paper difficult but also cause a paper printed with information to be rolled again into the printer 1.

Figure 33A:
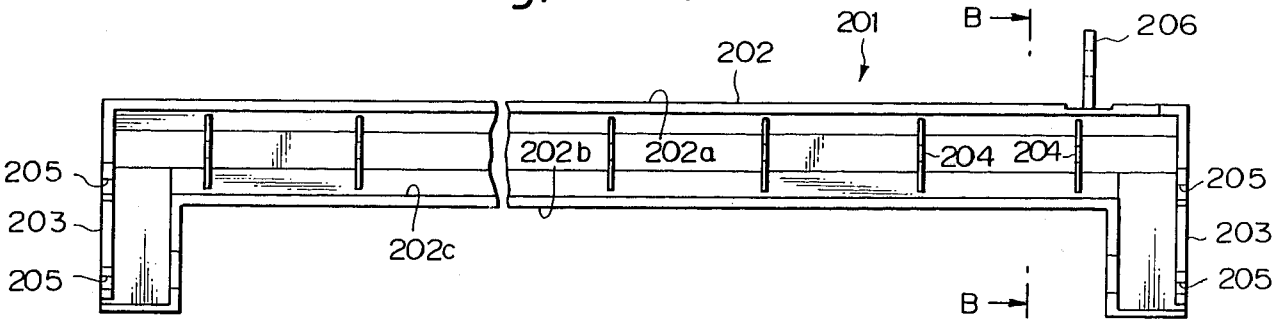
FIG. 33A is a rear view of a cover.
Figure 33B:
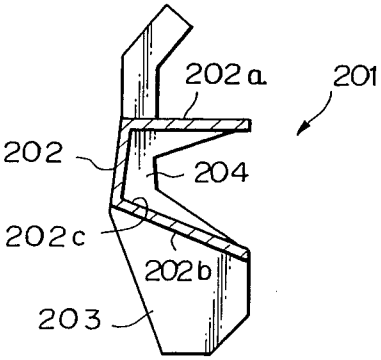
FIG. 33B is a section as seen in a direction B—B of FIG. 33A.

In the light of the above, in this particular embodiment, a cover 201, FIGS. 33A and 33B, is provided in the clearance region mentioned above. Specifically, the cover 201 includes a paper guide portion 202 and mounting portions 203. As shown in FIG. 33B, the guide portion 202 is provided with a generally U-shaped section so that its upper guide surface 202*a* may guide a fresh paper into the printer 1 while its lower guide surface 202*b* may guide a printed paper out of the printer 1. The interior of the "U" of the guide portion 202, or bore 202*c*, is provided with spaced ribs 204 for reinforcement. The front cover 3 extends forward beyond the guide portion 202 of the cover 201 and is provided with recesses 205 on the underside and adjacent to both side edges thereof. An arm 206 extends rearward from the cover 201 and bent downward. Four legs 207, FIG. 28, are provided on the rear side of both side walls of the top opepning 2*a* of the top cover 2. Further, a slot 208, FIG. 28, is formed through the top cover 2.

As shown in FIG. 28, the cover 201 is attached to the printer 1 with the lugs 207 of the printer 1 mated with the receses 205 of the cover 201 and such that the bore of the cover 201 faces the inward of the printer 1. In this condition, the mounting portion 203 on the left-hand side as viewed in FIG. 28 covers the top of the platen gear 148, and the arm 206 is received in the slot 208. A sensor adapted to sense the cover 201 is positioned below the slot 208 to be turned on and off by the arm 206. Likewise, an optional unit such as a form tractor is provided with an arm which penetrates to the slot 208 for the same purpose. When the sensor senses the removal of the cover 201 and does not sense an optional unit, the printer 1 is deactivated to ensure safety. While the cover 201 is mounted on the printer 1, the clearance between the top cover 2 and the guide surface 202*a* of the cover 201 and that between the guide surface 202*b* and the silencing cover 4 are narrow enough to silence printing noise.

The noise reduction is further enhanced by the bore 202*c* of the guide portion 202 of the cover 201 which serves to damp noise by reflection. Although the clearances are narrow as mentioned above, a recording paper is fed smoothly and positively because the paper is guided by the different guide surfaces 202*a* and 202*b* of the cover 201 with its part entering the printer 1 and part leaving the printer 1 separated by the cover 201. Furthermore, since the platen gear 148 is covered by the mounting portion 203, the operator is protected against injury when he or she opens the front cover 3.

The home position sensor means 74 associated with the type wheel 71 as shown in FIG. 19 will be described in detail hereinafter.

Figure 34:
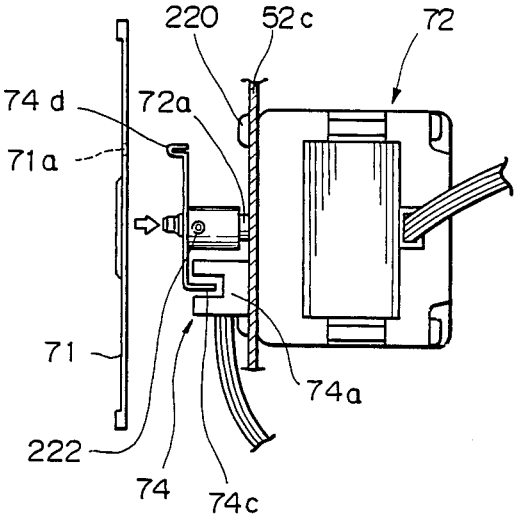
FIGS. 34 and 35 are views useful for explaining the detection of a home position of a type wheel and the presence of a type wheel.
Figure 35:
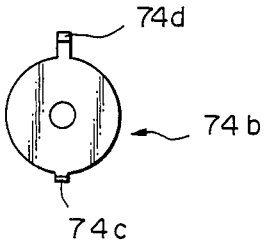

Refering to FIG. 34, the selection motor 72 is fixed to the support wall 52*c* of the carriage 52 by screws 220. The previously stated setter 74*b* for positioning the type wheel 71 is mounted on the output shaft 72*a* of the selection motor 72 by a screw 222. As shown in FIG. 35 also, the setter 74*b* is provided with the shutter piece 74*c*, and a lug 74*d* engageable with an aperture 71*a* of the type wheel 71 for positioning the type wheel 71. Also mounted on the support wall 52*c* is the support member 74*a* which is loaded with a light-emitting diode or like light emitting element and a phototransistor or like light sensitive element which face each other with the intermediary of the shutter piece 74*c*, i.e., a transmission type photosensor.

Figures 36, 36A:
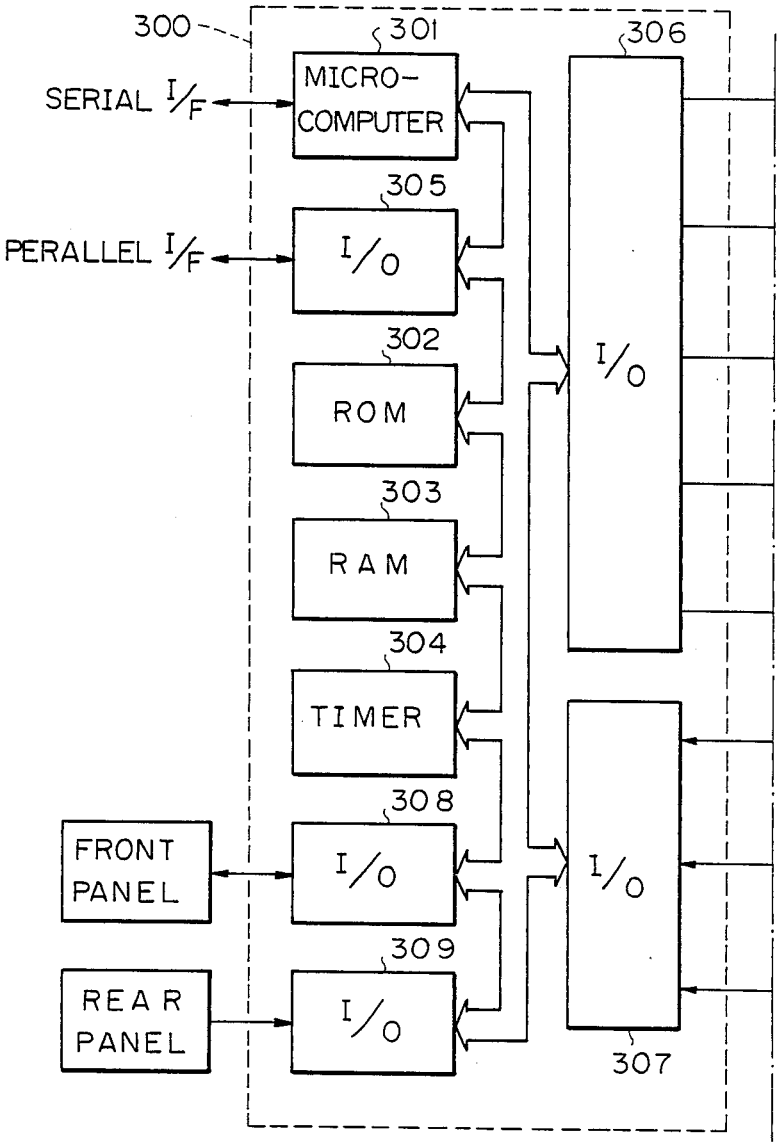
FIGS. 36A and 36B must be described is a block diagram showing a control system installed in the printing apparatus.
Figure 36B:
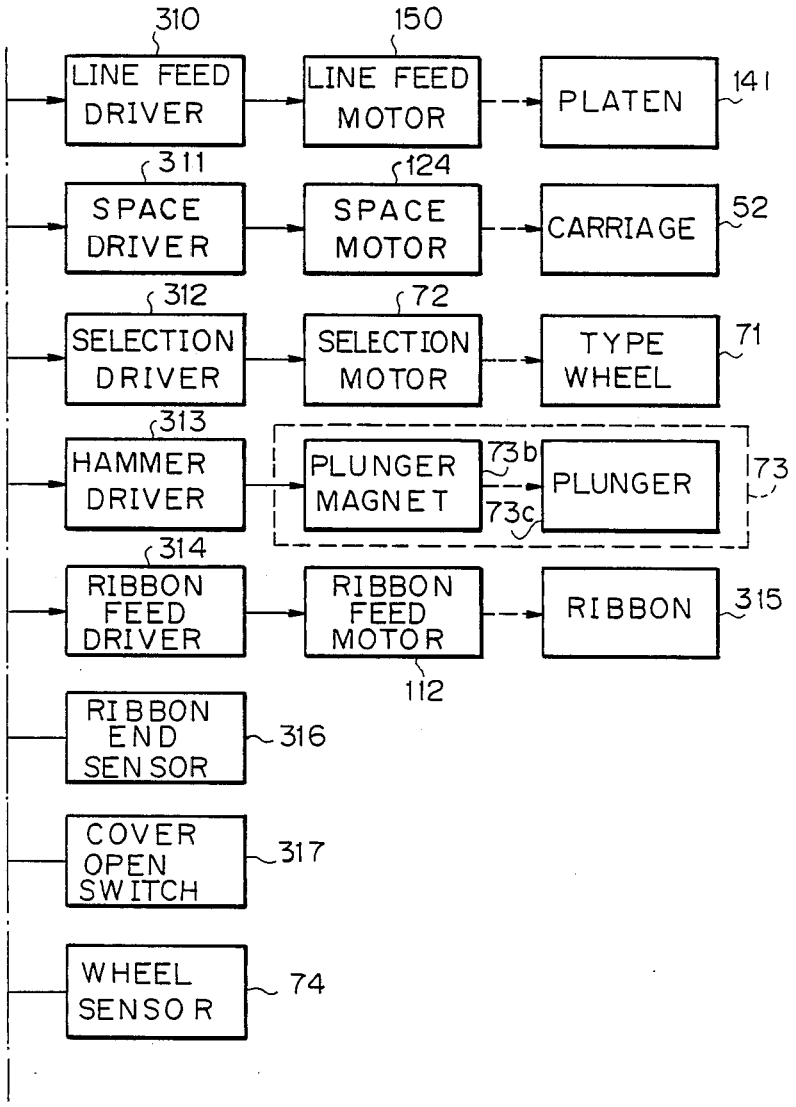

FIG. 36 is a block diagram showing a control arrangement of the printer 1. A main controller 300 includes a microcomputer 301 for controlling the entire printer 1, a read only memory (ROM) 302, a random access memory (RAM) 303, a one-chip timer unit 304 in which three programable timers capable of being loaded with time by the microcomputer 301 independently of each other are built in, and a parallel interface input/output (I/O) 305, and IOs 306 to 309.

The ROM 302 has a program area in which a control program associated with the print control and others is stored, a conversion table area in which a wheel address table for converting character codes into print positions (wheel address), a hammer pressure table for converting them into hammer pressures, a proportional space table for converting them into proportional space amounts and other various conversion tables are stored, an area in which speed tables associated with various stepping motors, e.g., drive switching frequency modes of stepping motors each corresponding to a respective one of various kinds of type wheels are stored, and an area in which other various fixed data are stored. It will be seen that the drive switching frequency modes stored in the ROM 302 allow the drive switching frequency to be changed over automatically based on the kind of the type wheel 71, e.g., a mold type or a metallic type, as will be described. The RAM 303 includes a receive buffer for temporarily storing data from a host (e.g. word processor, office computer or personal computer), a user area for down-loading various kinds of user data received from the host, and a working area (including a data area) for executing a program.

The microcomputer 301 performs processing in response to particular data transferred from the host to its own serial interface terminal or parallel I/O 305, e.g., character code, space (SP data), line feed (LF) data, and carriage return (CR) data. Specifically, the microcomputer 301 delivers a line feed drive pulse to a line feed drive 310 to drive a line feed motor 150, thereby rotating the platen 141 to feed a paper by each predetermined amount. The microcomputer 301 feeds a space drive pulse to a space driver 311 to drive a space motor 124 so as to move the carriage 52 by a predetermined amount in a predetermined direction to a print position. The microcomputer 301 applies a selection drive pulse to a selection driver 312 to drive the selection motor 72, whereby the type wheel 71 is rotated to bring a selected one of the types to an impact position where the hammer **73*a* is located. The microcomputer 301 delivers a hammer drive pulse to a hammer driver 313 to drive a plunger magnet 73*b* which constitutes the solenoid 73, thereby causing a plunger 73c to strike against the type of the type wheel 71**.

Further, the microcomputer 301 delivers a ribbon feed driver pulse to a ribbon feed driver 314 to drive a ribbon feed motor 112 to thereby feed a ribbon 315 by each predetermined amount. Fed to the microcomputer 301 via the I/O 307 are output signals of a ribbon end sensor 316, cover open switch 317, wheel sensor 74, paper end sensor, not shown, a carriage home sensor, not shown, and other various sensors. The microcomputer 301 fetches through the I/O 308 operation signals which are outputted by a pose switch and a line feed switch provided on a front panel, while turning on and off a paper end indicator, ribbon end indicator, and an error indicator. The microcomputer 301 further fetches through the I/O 309 data entered through DIP switches which are provided on a rear panel for selecting a baud rate, protocol, code system, type wheel, etc. The switch associated with the selection of a type wheel allows one to manually enter information which is representative of the kind of a type wheel selected. While such a switch is not essential in this particular embodiment because the printer discriminates a mold type type wheel and a metallic type type wheel automatically, it is provided for operator's convenience.

The operation of the embodiment described above will be explained with reference to FIGS. 37 to 41.

Figure 37A:
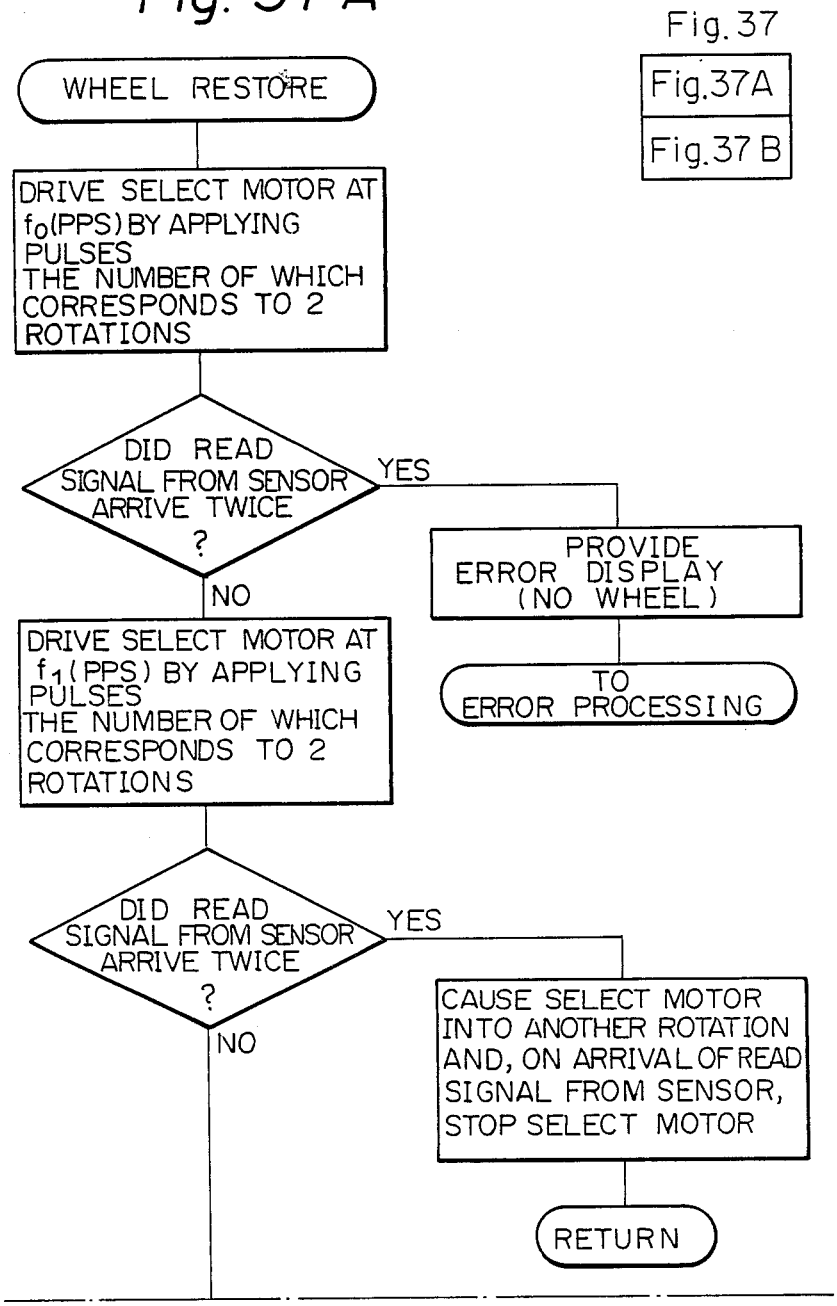
FIGS. 37A and 37B and 38 are, respectively, a flowchart demonstrating an example of wheel restore processing, and a plot representative of a motor characteristic useful for explaining the wheel restore processing.
Figure 37B:
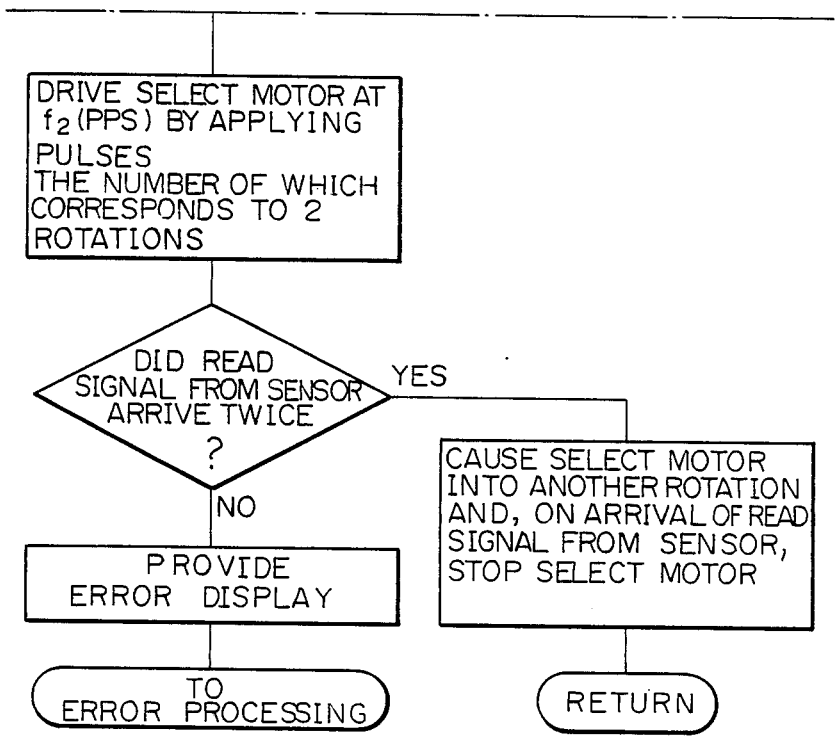

To begin with, there will be described the decision as to the presence/absence and the kind of a type wheel. Assume that two kinds of type wheels which are different in weight, or inertia moment, are usuable with the printer, i.e., a mold type and a metallic type. When the cover 3 is opened or closed, and when an initialize signal from the host is received, the microcomputer 301 performs a restore or initialize operation. As a part of the restore operation, the microcomputer 301 detects presence/absence and the kind of the type wheel 71 according to wheel restore processing as shown in FIG. 37, which is adapted to bring the type wheel 71 to its home position.

Specifically, the microcomputer 301 applies to the selection motor 72, which is implemented with a stepping motor, a predetermined number of drive pulses corresponding to two full rotations of the type wheel 71, or those of the motor 72, at a first drive frequency $f_o$ (PPS), thereby rotating the motor 72. The first drive frequency $f_o$ is selected to be close to the maximum self-start frequency of the selection motor 72, in this particular embodiment a frequency slightly lower than it to provide a margin. While the selection motor 72 is driven, whether or not a signal which the wheel sensor 74 is to produce when sensed the shutter piece **74*c* of the setter 74*b* (hereinafter referred to as a read signal) has been inputted twice is decided. Since the first drive frequency $f_o$ is slightly lower than the maximum self-start frequency of the selection motor 72 as stated above, if the type wheel 71 is absent, the selection motor 72 successfully completes two rotations without misstepping to cause the read signal to appear twice. If the type wheel 71 is present, the selection motor 72 missteps due to the load which is constituted by the inertia moment of the type wheel 71, resulting that the read signal does not appear twice. When the read signal has been inputted twice, the microcomputer 301 decides that the type wheel 71** is absent, then provides an error display (no wheel), and then stops the printer to enter into error processing.

When the read signal from the wheel sensor 74 has not been inputted twice, it means that the selection motor 72 has misstepped and, therefore, the type wheel 71 has not been loaded. It follows that the presence/absence of the type wheel 71, or driven member, can be determined by switching the drive frequency of the selection motor 72, or stepping motor. The two rotations of the selection motor 72 is adopted for the elimination of erroneous detection. Specifically, the shutter **74*c* of the setter 74*b* may accidentally be held in alignment with the wheel sensor 73. Under this condition, should the selection motor 72 be rotated only once, the microcomputer 301 would decide that even when the selection motor 72 has misstepped, the read signal from the wheel sensor 74 has been inputted, i.e., that the type wheel 71** is absent.

When the selection motor 72 has misstepped at the first drive frequency $f_o$ to prevent the read signal from being produced by the wheel sensor 74 twice, the microcomputer 301 decides that the type wheel 71 is present and, in order to identify the kind of the type wheel 71, applies to the selection motor 72 a predetermined number of pulses corresponding to two rotations of the selection motor 72 at a second drive frequency $f_1$ (PPS). It is to be noted that the second drive frequency $f_1$ is selected such that the selection motor 72 self-starts for a type wheel whose inertia moment is comparatively small and and misstpes for a type wheel whose inertia moment is comparatively large. Again, while the selection motor 72 is rotated twice, the microcomputer 301 decides whether or note the read signal has been produced by the wheel sensor 74 twice.

If the type wheel 71 loaded is of the kind having a comparatively small inertia moment, the selection motor 72 does not misstep so that the read signal from the wheel sensor 74 arrives twice. On the other hand, if the type wheel 1 is not of the kind mentioned above, the selection motor 72 missteps and, therefore, the read signal does not arrive twice. Hence, when the read signal from the wheel sensor 74 has been inputted twice, meaning that the type wheel 71 is the one having a comparatively small ienrtia moment, the microcomputer 301 causes the selection motor 72 to perform another full rotation and, on the arrival of the read signal from the wheel sensor 74, stops the rotation of the motor 72 determining that the position of that instant is the home position of the type wheel 71.

If the read signal from the wheel sensor 74 is not inputted twice, meaning that the selection motor 72 has misstepped and, therefore, the type wheel 71 is not the one having a comparatively small inertia moment, the microcomputer 301 delivers a predetermined number of pulses corresponding to two full rotations of the selection motor 72 at a third drive fequency $f_2$ (PPS) is so selected as to cause the selection motor 72 to self-start for a type wheel whose inertia moment is comparatively large and to misstep for a type wheel having a still larger inertia moment. Again, while the drive pulses corresponding to two rotations of the selection motor 72 are applied, the microcomputer 301 decides whether or not the read signal from the wheel sensor 74 has arrived twice.

If the type wheel 71 loaded is of the kind having a comparatively large inertia moment, the selection motor 72 does not misstep so that the read signal from the wheel sensor 74 arrives twice. If the type wheel 71 is of the kind having still larger inertia moment (hereinafter referred to as an unqualified type wheel) than the one having a comparatively large inertia moment and in other similar situations, the selection motor 72 missteps to prevent the read signal from being generated twice by the wheel sensor 74. Hence, when the read signal has been inputted twice from the wheel sensor 74, meaning that the type wheel 71 is of the kind having a comparatively large inertia moment, the microcomputer 301 causes the selection motor 72 into another full rotation and, on the arrival of the read signal from the wheel sensor 72, stops the rotation of the motor 72 determining that the position of that instant is the home position of the type wheel 71.

When the read signal has not been generated twice by the wheel sensor 74, meaning that the type wheel 71 is an unqualified type wheel, the microcomputer 301 provides an error display and enters into error processing because a stepping motor drive switching frequency mode for such a type wheel is not stored in the ROM 302 or because the selection motor 72 or its associated drive system may have failed and/or the type wheel 71 may have been locked due to entry of screws and others in the type selection mechanism.

As stated above, by switching the drive frequency applied to the selection motor 72, it is possible to determine the presence/absence of the type wheel 71 and, at the same time, to identify the kind of the type wheel 71 based on the difference of inertia moment, i.e. weight. The result of such identification is used to automatically select a particular drive switching frequency mode of the selection motor 72. Specifically, while the selection motor 72 is driven by a so-called through-up through-down control which accelerates or decelerates the motor 72 little by little, it is desirable that the through rate be changed depending upon the kind of the type wheel 71 from the viewpoint of printing rate or printing quality. Thus, the selection motor 72 can be controllably driven at an optimum through rate by identifying the kind of the type wheel 71 and, thereby, selecting a particular drive switching frequency mode, as in the printer of this embodiment.

Figure 38:
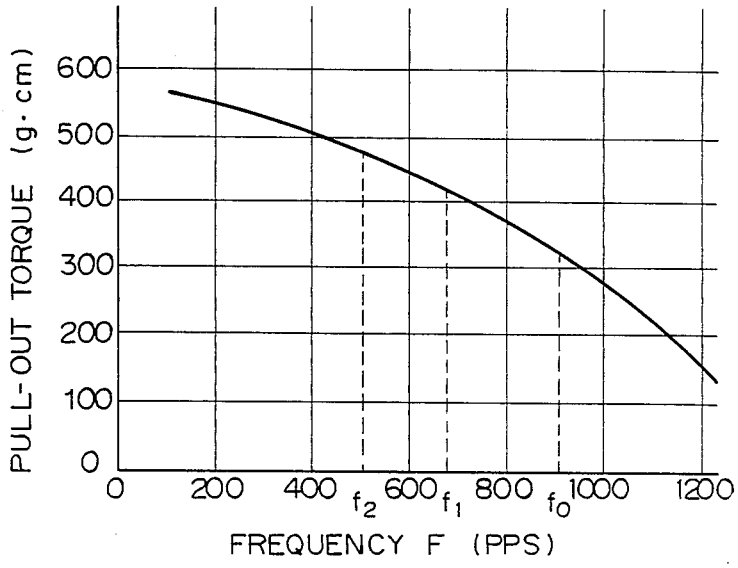

The wheel restore processing will hereinafter be described more specifically. It is assumed that the printer is operable with a mold type type wheel whose inertia moment $JL_1$ is comparatively small (27 to 32 g·cm$^2$), and a metallic type type wheel whose inertia moment $JL_2$ is comparatively large (50 to 57 g·cm$^2$). It is further assumed that the selection motor 72 has a particular pull-out torque characteristic as shown in FIG. 38, the rotor of the motor 72 has an inertia moment JR of 16 g·cm$^2$, and the motor 72 has a friction torque TF of 60 g·cm and a stepping angle $\theta s$ of 1.875 degrees. The pull-out torque Tout needed for a stepping motor to self-start and the drive frequency f (PPS) may generally expressed as:

$$Tout = \left\{ \frac{(JR + JL)}{980} \times \theta_s \times \frac{\pi}{180} \times \frac{f^2}{2} \right\} + TF$$

Hence, the first drive frequency $f_o$ adapted to decide whether the type wheel 71 is present or not is produced by:

$$f_0 = \sqrt{\frac{Tout - TF}{\left\{ \frac{(JR + JL)}{980} \times \theta_s \times \frac{\pi}{180} \times \frac{1}{2} \right\}}}$$

$$= \sqrt{\frac{300 - 60}{\left\{ \frac{(16 + 0)}{980} \times 1.875 \times \frac{\pi}{180} \times \frac{1}{2} \right\}}} = 947.8 \text{ (PPS)}$$

In this particular embodiment, the first drive frequency $f_o$ is selected to be approximately 900 (PPS) with a margin taken into account.

Assume that among mold type type wheels which are the type wheels having comparatively small inertia moments, a type wheel whose inertia moment $JL_1$ is smallest (27 g·cm$^2$) is loaded in the printer. Then, the motor torque Tout needed for the selection motor 72 to operate without misstepping is produced by:

$$Tout = \frac{(16 + 27)}{980} \times 1.875 \times \frac{\pi}{180} \times \frac{900^2}{2} + 60 = 641.5[g \cdot cm]$$

Since this torque Tout is sufficiently greater than the motor output torque Tout of 320 g·cm which is associated with first drive frequency $f_o$ (900 PPS), the selection motor 72 driven at the first drive frequency $f_o$ with the type wheel 71 loaded in the printer missteps without fail and, therefore, the wheel sensor 74 does not generate the read signal.

As regards the second drive frequency $f_1$ adapted to determine whether or not the type wheel 71 is of the kind having a comparatively small inertia moment, it may be selected to match with, among the type wheels having comparatively small inertia moments, a type wheel whose inertia moment $JL_1$ is greatest (32 g·cm$^2$), as follows:

$$f_1 = \sqrt{\frac{420 - 60}{\frac{(16 + 32)}{980} \times 1.875 \times \frac{\pi}{180} \times \frac{1}{2}}} = 670.2 \text{ (PPS)}$$

Hence, a frequency of 660 (PPS) is selected for the second drive frequency $f_1$.

Next, assume that among metallic type type wheels which are the type wheels of the kind having comparatively large inertia moments, a type wheel whose inertia moment $JL_2$ is smallest (50 g·cm$^2$) is loaded in the printer. Then, the motor torque Tout needed for the selection motor 72 to operated without misstepping is produced by:

$$Tout = \frac{(16 + 50)}{980} \times 1.875 \times \frac{\pi}{180} \times \frac{660^2}{2} + 60 = 540[\text{g} \cdot \text{cm}]$$

Since this torque is sufficiently greater than the motor output torque Tout of 420 g·cm which is associated with the second drive frequency $f_1$ of 660 (PPS), the selection motor 72 driven at that frequency $f_1$ with the type wheel 71 having a comparatively large inertia moment missteps without fail so that the wheel sensor 74 does not generate the read signal.

As for the third drive frequency $f_2$ adapted to decide whether the type wheel 71 loaded is of the kind having a comparatively large inertia moment, it may be selected to match with, among type wheels having comparatively large inertia moments, a type wheel whose inertia moment $JL_2$ is largest (57 g·cm$^2$), as follows:

$$f_2 = \sqrt{\frac{440 - 60}{\frac{(16 + 57)}{980} \times 1.875 \times \frac{\pi}{180} \times \frac{1}{2}}} = 558.4 \text{ (PPS)}$$

In this instance, since a sufficient margin is available with this printer which does not use type wheels having still greater inertia moments, a frequency of 500 PPS which is lower than 550 PPS is selected for the third drive frequency $f_2$. In this condition, if the selection motor 72 is driven at the third drive frequency $f_2$ of 500 PPS while a type wheel whose inertia moment is far greater than that of, among the type wheels having comparatively large inertia moments, the one whose inertia moment is largest is loaded, the motor 72 missteps to prevent the wheel sensor 74 from producing the read signal.

The presence/absence of the type wheel 71 and its kind (mold type or metallic type) are determined by the procedure described above.

It is to be noted that the period of time required for the decision of presence/absence of the type wheel 71 and the identification of its kind is negligible:

(1) When the type wheel 71 is absent, $$\frac{360}{\theta_s} \times 2 \div f_0 = \frac{360}{1.875} \times 2 \div 900 = 0.427 \text{ (sec)}$$

(2) When a type wheel having a comparatively small inertia moment is loaded, $$(1) + \frac{360}{\theta_s} \times 3 \div f_1 = 0.427 + \frac{360}{1.875} \times 3 \div 660 = 1.30 \text{ (sec)}$$

(3) When a type wheel having a compatively large inertia moment is loaded, $$(1) + (2) + \frac{360}{\theta_s} \times 3 \div f_2 = 1.30 + \frac{360}{1.875} \times 3 \div 500 = 2.45 \text{ (sec)}$$

When the difference in inertia moment between type wheels usable with the printer is small and/or when many kinds of type wheels are usable, all that is required for more delicate decision is increasing the number of drive frequencies such as to the first frequency $f_o$ to the "n" frequency $f_{n-1}$. In case that such drive frequencies cannot be readily set up accommodating scatterings in the motor pull-out torque characteristic, drive voltage, ambient temperature and others during quantity production, what is needed is simply selecting a motor and finely adjusting the drive frequency.

If desired, the drive which uses a constant drive frequency as described above may be replaced with a through-up drive which accelerates a motor little by little, in order to reduce the restore or initialize operation time. In such an alternative case, the presence/absence and the kind of a type wheel can be determined by performing processing similar to that of FIG. 37 using the previously mentioned general equation of the pull-out torque Tout and drive frequency f and the following equation:

$$Tout = \left\{ \frac{(JR + JL)}{980} \times \theta_s \times \frac{\pi}{180} \times \frac{(f' - f')}{ta} \right\} + FL$$

where ta is the period of time (sec) needed for the acceleration from a drive frequency f' to a drive frequency f''.

The detection of the presence/absence and the kind of a type wheel which is effected by switching the drive frequency of a stepping motor is practicable by utilizing the misstepping of a stepping motor and, therefore, applicable only to a case wherein a stepping motor is controlled by an open loop (open control). Specifically, when a closed control is applied to a stepping motor with an encoder mounted on the motor, the motor does not misstepp at all so that the presence/absence and the kind of a type wheel cannot be decided even if the drive frequency is switched. In case that a stepping motor is close-controlled, there should preferably be adopted a method which effects such decision based on the intervals of pulses which are inputted from the encoder.

To further enhance the accuracy of detection, the drive frequencies $f_o$, $f_1$, $f_2$ and others and the detection timings may be held in synchronism with each other.

Figure 39:
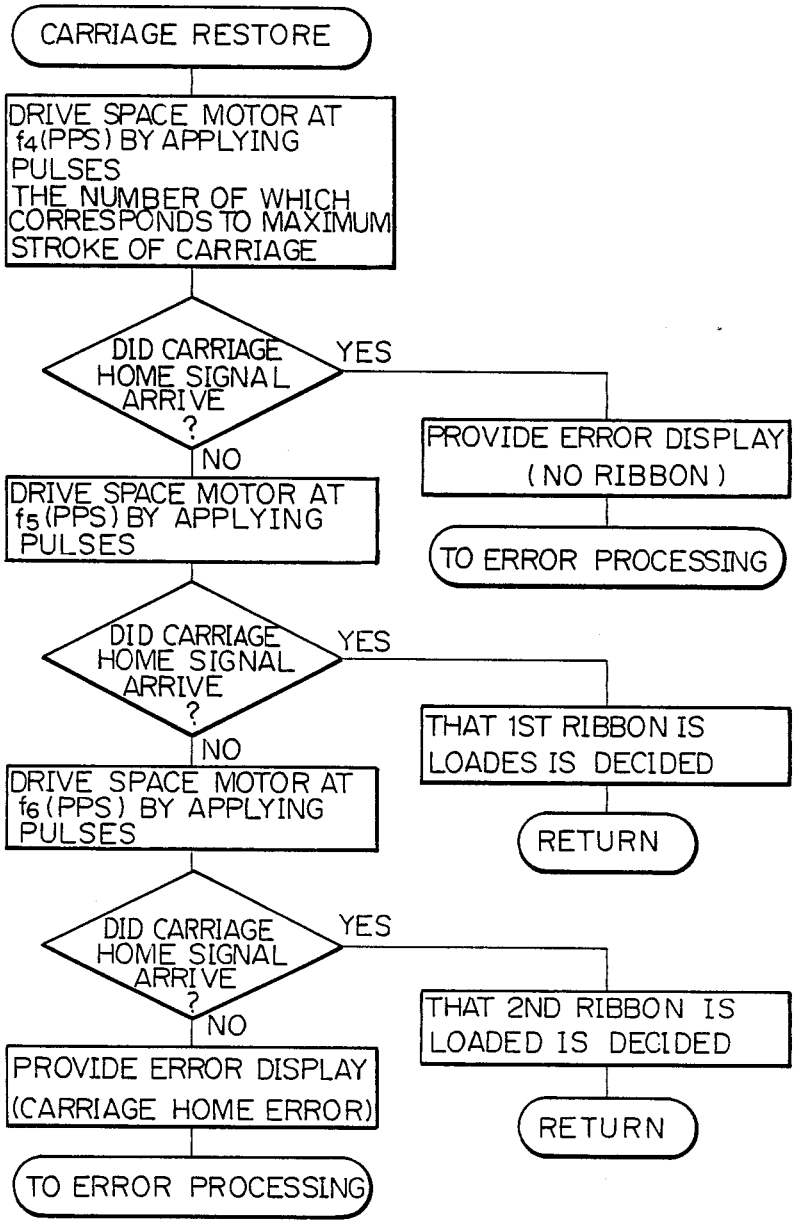
FIG. 39 is a flowchart demonstrating an example of carriage restore processing.

Referring to FIG. 39, there is shown carriage restore processing which is executed by the microcomputer 301 for bringing the carriage 52 to its home position. In this processing, as in the wheel restore processing, a predetermined number of pulses corresponding to the maximum stroke of the carriage 52 is applied to the space motor 124 at a first drive frequency $f_4$ (PPS) so as to rotate the motor 124. The first drive frequency $f_4$ is so selected as to allow the motor to selfstart while a ribbon cartridge is not loaded on the carriage 52, and to misstep while a ribbon cartridge is loaded. Then, the microcomputer 301 decides whether or not a carriage home signal which a carriage home sensor produces when sensed the carriage 52 has arrived. Since the number of drive pulses applied corresponds to the maximum stroke of the carriage 52, the carriage 52 is moved to its home position without fail insofar as the space motor 124 does not misstep. Hence, if the carriage home sensor has been inputted, meaning that the space motor 124 has not misstepped and, therefore, that the carriage 52 is not loaded with a ribbon cartridge, the microcomputer 301 provides an error display (no ribbon) and, then, enters into error processing.

If the carriage home sensor has not been inputted, meaning that the space motor 124 has misstepped due to, presumably, the absence of a ribbon cartridge on the carriage 52, the microcomputer 301 drives the space motor 124 at a second drive frequency $f_5$ (PPS) which does not cause the motor 124 to misstep even if the carriage 52 is loaded with a ribbon cartridge. The second drive frequency $f_5$ is so selected as to allow the space motor 124 to self-start when, among those ribbon cartridges accommodating ribbons which are different in inertia moment such as a multistrike ribbon and a non-time ribbon, a ribbon cartridge accommodating a ribbon whose inertia moment is smaller (hereinafter referred to as a first ribbon) is loaded, and to misstep pwhen a ribbon cartridge accommodating a ribbon whose inertia moment is larger (hereinafter referred to as a second ribbon) is loaded. In the above condition, the microcomputer 301 decides whether the carriage home signal from the carriage home sensor has been inputted and, if it has been inputted, gets away from the carriage restore processing determining that the ribbon loaded is the first ribbon.

If the carriage home signal has not been inputted, the microcomputer 301 drives space motor 124 at a third drive frequency $f_6$ (PPS) which allows the motor 124 to self-start when the carriage 52 is loaded with the second ribbon and to misstep when the inertia moment is greater than that of the second ribbon. Subsequently, the microcomputer 301 sees if the carriage home signal from the carriage home sensor has arrived and, if it has arrived, decides that the ribbon loaded is the second ribbon determining that the space motor 124 has not misstepped; if the carriage home signal has not arrived, the microcomputer 301 provides an error display (carriage home error) deciding that carriage lock or like failure has occurred and, then, starts on error processing.

As stated above, the prsence/absence and the kind of a ribbon are determined by switching the drive frequency of the space motor 124.

It will be seen from the above that this printer, or printing apparatus, senses the presence/absence of a driven member, which is driven by a stepping motor, by switching the drive frequency of the motor and, therefore, it is free from limitations otherwise imposed on the detection by the driven member. Such increases the range of type wheels with which the printer is operable and, thereby, the applicable range of the printer.

While the embodiment of the present invention has been shown and described in relation to the detection of the presence/absence and the kind of a type wheel and those of a ribbon of a printer of the king using a type wheel, the present invention is similarly applicable to a thermal printer for detecting the presence/absence of and the kind of a thermal head as well as to an ink jet printer for detecting the presence/absence of an ink tank and the remaining amount of ink.

Figure 40:
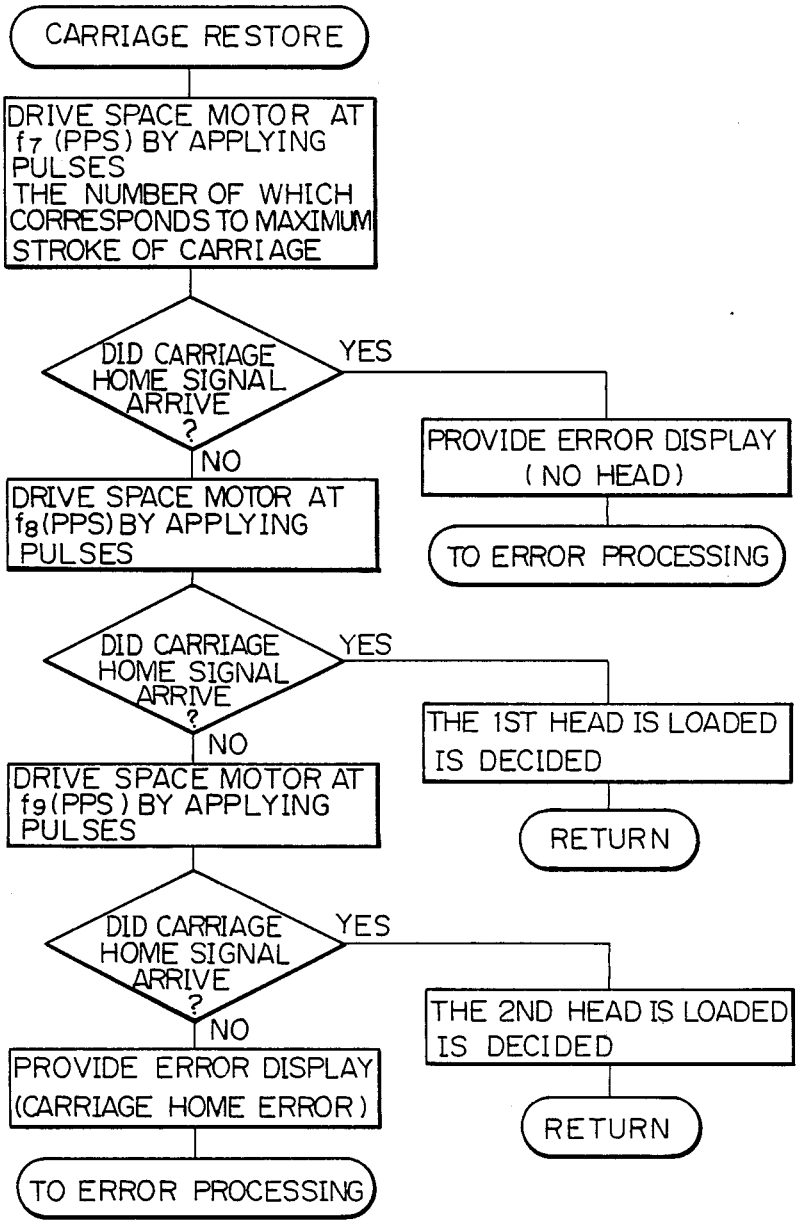
FIGS. 40 and 41 are flowcharts demonstrating an example of carriage restore processing in accordance with another embodiment of the present invention.

Referring to FIG. 40, there is shown an example of carriage restore processing of detecting the presence/absence and the kind of a thermal head of a thermal printer. In this processing, it is assumed that the thermal printer is operable with two kinds of thermal head which are different in inertia moment, the thermal head having a smaller inertia moment being referred to as a first head and the one having a larger inertia moment as a second head. As regards the various drive frequencies, a first drive frequency $f_7$ (PPS) is selected to allow a stepping motor to self-start when no thermal head is loaded, a second drive frequency $f_8$ (PPS) to allow the motor to self-start when the first head is loaded and to misstep when the inertia moment is greater than that of the first head, and a third drive frequency $f_9$ to allow the motor to self-start when the second head is loaded and to misstep when the inertia moment is greater than that of the second head. The processing for determining the presence/absence and the kind of a thermal printer is similar to that of FIG. 39.

Figure 41:
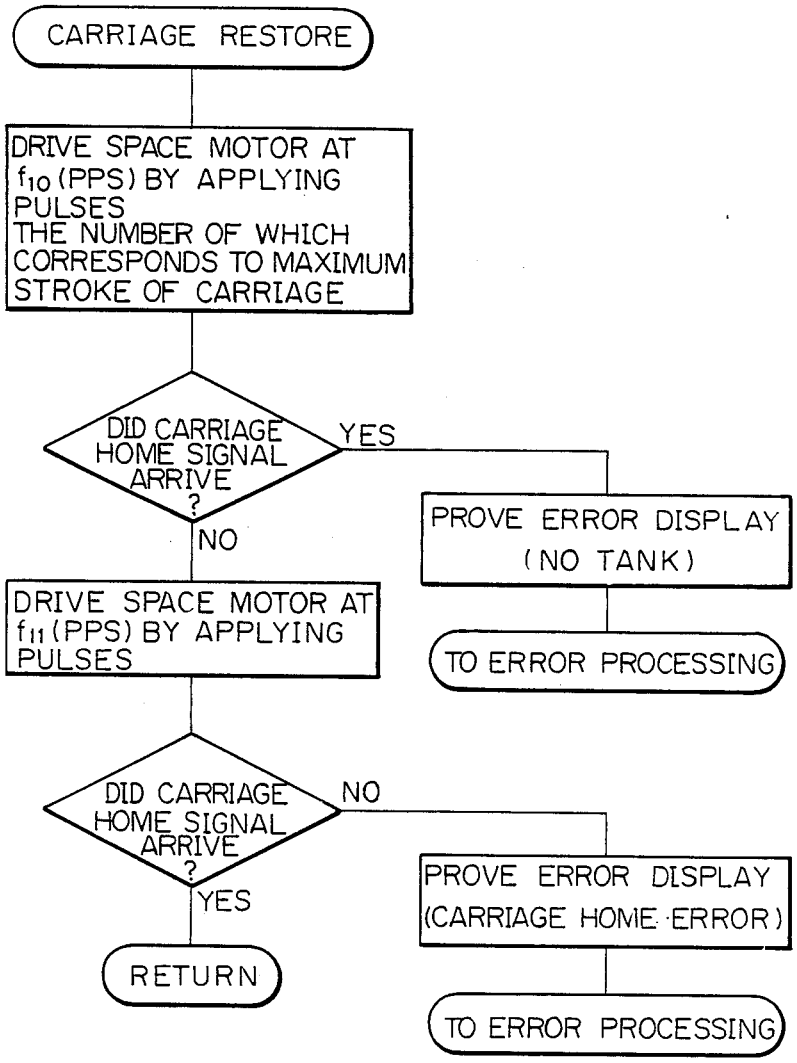

FIG. 41 shows processing which may be executed in an ink jet printer to decide the presence/absence of an ink reservoir, or ink tank. In this processing, too, a first drive frequency $f_{10}$ (PPS) is selected to allow a stepping motor to self-start when no ink tank is loaded and to misstep when an ink tank is loaded, and a second drive frequency $f_{11}$ (PPS) to allow the motor to self-start when an ink tank is loaded and to misstep when the inertia moment is greater than that of the ink tank. Since the inertia moment of the ink tank depends on the remaining amount of ink, the latter can be detected also, by selecting drive frequencies corresponding to the different inertia moments.

The present invention is applicable not only to a printer of the type using a type wheel, a thermal printer and an ink jet printer as stated above but also to a dot impact printer. Further, the present invention is applicable not only to Receive/Only (R/O) printers but also to an electronic typewriter, a word processor and like printing apparatus. In addition, the applicable range of the present invention further covers all kinds of apparatus other than printing apparatus which need an implementation for detecting the presence/absence and the kind of a driven member which is driven by a stepping motor. In any of such applications, the precondition for the identification of a kind is that the driven members are different in weight from each other.

The embodiment described above may practiced with, instead of a selection motor or a space motor, a line feed motor so as to determine the presence/absence of an automatic sheet feeding device of the type being driven by the rotation of the platen of the printing apparatus, e.g. an ASF (auto sheet feeder) or a form tractor. This is possible because the load acting on the line feed motor depends on the presence/absence and the kind of such an automatic sheet feeding device. Likewise, the principle of the present invention is applicable to a ribbon feed motor for deciding the presence/absence and the kind of a ribbon. Further, the kinds of type wheels to be discriminated are not limited to a mold type and a metallic type as stated and may comprise a single type type wheel provided with a single type arrangement and a double type type wheel provided with a double type arrangement.

Various modifications will become possible for those skilled in the art after receiving the teachings of the present disclosure without departing from the scope thereof.

What is claimed is:

1. A printing apparatus having a platen, comprising:

a pair of side frames (11, 12);

a guide member (13) extending between said side frames;

a carriage loaded with a printing mechanism and slidably supported by said guide member to move along the platen; and a stay (14) interconnecting said side frames (11, 12), said stay (14) being provided with lugs (14*a*) which are integral therewith for engaging said side frames (11, 12);

said side frames (11, 12) being individually provided with positioning openings (15, 16 and/or 21) each mating with a respective one of positioning pins (34, 35 and/or 36) which are provided on a supporting member (31) for temporarily supporting said side frames (11, 12) at the time when said stay (14) and said side frames (11, 12) are to be fixed in an interconnected condition, and said stay (14) being provided with positioning holes (14b) mating with a respective one of positioning pins (33) which are provided on said supporting member (31), to thereby temporarily affix said side frames (11, 12) and said stay (14) relative to each other for assembly with each other.

2. A printing apparatus as claimed in claim 1, wherein each of said side frames is each provided with a plurality of openings (20) with which said integral lugs (14*a*) individually mate, said lugs (14*a*) protruding outwardly from said side frames (11, 12) while said side frames are pressed toward each other to thereby sqeeze said lugs (14*a*) while said side frames are temporarily supported by the mating of said pins with said positioning openings and positioning holes.

3. A printing apparatus as claimed in claim 1, wherein each of said side frames comprises a sheet metal.

4. A printing apparatus as claimed in claim 1, wherein said printing mechanism includes a type wheel and a hammer.

5. A printing apparatus as in claim 2 in which said stay (14) has a bent configuration to increase the mechanical strength thereof.

6. A printing apparatus as in claim 2 in which said side frames (11, 12) are provided with guide member receiving holes (16) and said guide member (13) which slidably supports said carriage is fixed in place relative to said side frames (11, 12) by engaging said guide member receiving holes.

7. A printing apparatus as in claim 2 in which said side frames (11, 12) and said stay (14) are affixed by said supporting member (31) for assembly in a position in which said side frames are perpendicular to said stay.

* * * * *